US011272580B2

(12) United States Patent
Brook et al.

(10) Patent No.: US 11,272,580 B2
(45) Date of Patent: Mar. 8, 2022

(54) CONDUCTIVE TRANSFER

(71) Applicant: CONDUCTIVE TRANSFERS LIMITED, Barnsley (GB)

(72) Inventors: Paul Timothy Brook, Barnsley (GB); Raymond Bungay, Poole (GB); Mark John Catchpole, Ely (GB); Melvyn Revitt, Sheffield (GB); Steven Paul Sutcliffe, Doncaster (GB)

(73) Assignee: CONDUCTIVE TRANSFERS LIMITED, Barnsley (GB)

( * ) Notice: Subject to any disclaimer, the term of this patent is extended or adjusted under 35 U.S.C. 154(b) by 0 days.

(21) Appl. No.: 17/258,194

(22) PCT Filed: Jul. 6, 2019

(86) PCT No.: PCT/GB2019/000093
§ 371 (c)(1),
(2) Date: Jan. 6, 2021

(87) PCT Pub. No.: WO2020/008162
PCT Pub. Date: Jan. 9, 2020

(65) Prior Publication Data

US 2021/0251047 A1 Aug. 12, 2021

(30) Foreign Application Priority Data

Jul. 6, 2018 (GB) ..... 1811203

(51) Int. Cl.
*H05B 3/34* (2006.01)
*H05B 3/12* (2006.01)

(52) U.S. Cl.
CPC ..... *H05B 3/342* (2013.01); *H05B 3/12* (2013.01); *H05B 2203/013* (2013.01);
(Continued)

(58) Field of Classification Search
CPC .... H05B 3/342; H05B 3/12; H05B 2203/036; H05B 2203/02; H05B 2203/013;
(Continued)

(56) References Cited

U.S. PATENT DOCUMENTS 6,237,874 B1 * 5/2001 Rutherford ..... B64D 15/14 244/134 D
9,161,393 B2 10/2015 Kaiserman et al.
(Continued)

FOREIGN PATENT DOCUMENTS

GB 2555592 A 5/2018
WO 2015066462 A1 5/2015
(Continued)

OTHER PUBLICATIONS

Corresponding International Application No. PCT/GB2019/000093, International Search Report and Written Opinion, dated Dec. 9, 2019.
(Continued)

*Primary Examiner* — Shawntina T Fuqua
(74) *Attorney, Agent, or Firm* — Cooper Legal Group, LLC

(57) ABSTRACT

A conductive transfer 201 for application to a surface includes two non-conductive ink layers 202, 203. A heating element 204 is positioned between the two non-conductive ink layers. An adhesive layer 207 for adhering said conductive transfer to a surface is also present. The heating element comprises an electrically conductive ink 205 having a positive temperature coefficient such that the electrically conductive ink exhibits an increase in resistance in response to an increase in temperature. A method of production of the conductive transfer involves a printing process.

33 Claims, 20 Drawing Sheets

(52) U.S. Cl.
CPC .... *H05B 2203/017* (2013.01); *H05B 2203/02* (2013.01); *H05B 2203/036* (2013.01)

(58) Field of Classification Search
CPC .... H05B 2203/017; H05B 3/34; H05B 3/345; H05B 3/347; H05B 3/02; H05B 2203/003; H05B 2203/005; H05B 2203/011; H05B 2203/026; H05B 2203/029; H05B 2214/04; A43B 3/0005; A43B 5/0415; A43B 7/02; A43B 7/04
See application file for complete search history.

(56) References Cited

U.S. PATENT DOCUMENTS

2007/0068923 A1* 3/2007 Augustine ..... H05B 3/342 219/465.1
2015/0122791 A1* 5/2015 Hung ..... A41D 13/005 219/211

FOREIGN PATENT DOCUMENTS

WO 2017147480 A1 8/2017
WO 2017209938 A1 12/2017

OTHER PUBLICATIONS

Corresponding International Application No. PCT/GB2019/000093, International Preliminary Report on Patentability, dated Jun. 10, 2020.

* cited by examiner

CONDUCTIVE TRANSFER

CROSS REFERENCE TO RELATED APPLICATIONS

This application claims priority from United Kingdom Patent Application number GB 18 11 203.7, filed on 6 Jul. 2018, the whole contents of which are incorporated herein by reference.

BACKGROUND OF THE INVENTION

The present invention relates to a conductive transfer and a method of producing a conductive transfer.

Heated articles, such as heated items of clothing including jackets, are known. Articles of this type conventionally utilise a heating element which supplies heat into the jacket to keep a wearer warm. The heating element typically comprises electrical wiring, however this can be uncomfortable and/or bulky to wear and cumbersome to manufacture.

Printed heating elements have been proposed as an alternative. These alternatives typically include rigid or semi-rigid substrates onto which the heated electrical component can be printed. When used in heated items of clothing, however, while the substrates may have a degree of flexibility in terms of flexural strength, they lack flexibility in terms of tensile or compressive forces. Thus, these types of heating arrangements are generally unsuitable for applications such as heated items of clothing, as they are not able to stretch in line with the material of the item of clothing. The applicant has developed a conductive transfer which is disclosed in patent publication GB 2 555 592 which provides an electrically conductive circuit which can be applied to suitable articles or surfaces. A problem in applying this conductive transfer as a heating element is that the current transfer can lead to overheating and a lack of stability, in particular in relation to the current flow through the conductive ink itself. In an extreme case, this leads to fire hazards created by the transfer.

In attempting to overcome these problems, it is also noted that ensuring an adequate heat output from the conductive transfer while also preventing overheating has proven difficult. The present invention aims to address these problems.

BRIEF SUMMARY OF THE INVENTION

According to an aspect of the present invention, there is provided a conductive transfer for application to a surface, according to claim 1.

According to a further aspect of the present invention, there is provided a method of producing a conductive transfer for application to a surface, according to claim 30.

Embodiments of the invention will be described, by way of example only, with reference to the accompanying drawings. The detailed embodiments show the best mode known to the inventor and provide support for the invention as claimed. However, they are only exemplary and should not be used to interpret or limit the scope of the claims. Their purpose is to provide a teaching to those skilled in the art.

Components and processes distinguished by ordinal phrases such as "first" and "second" do not necessarily define an order or ranking of any sort.

DETAILED DESCRIPTION OF EMBODIMENTS OF THE INVENTION

FIG. 1

Figure 1:
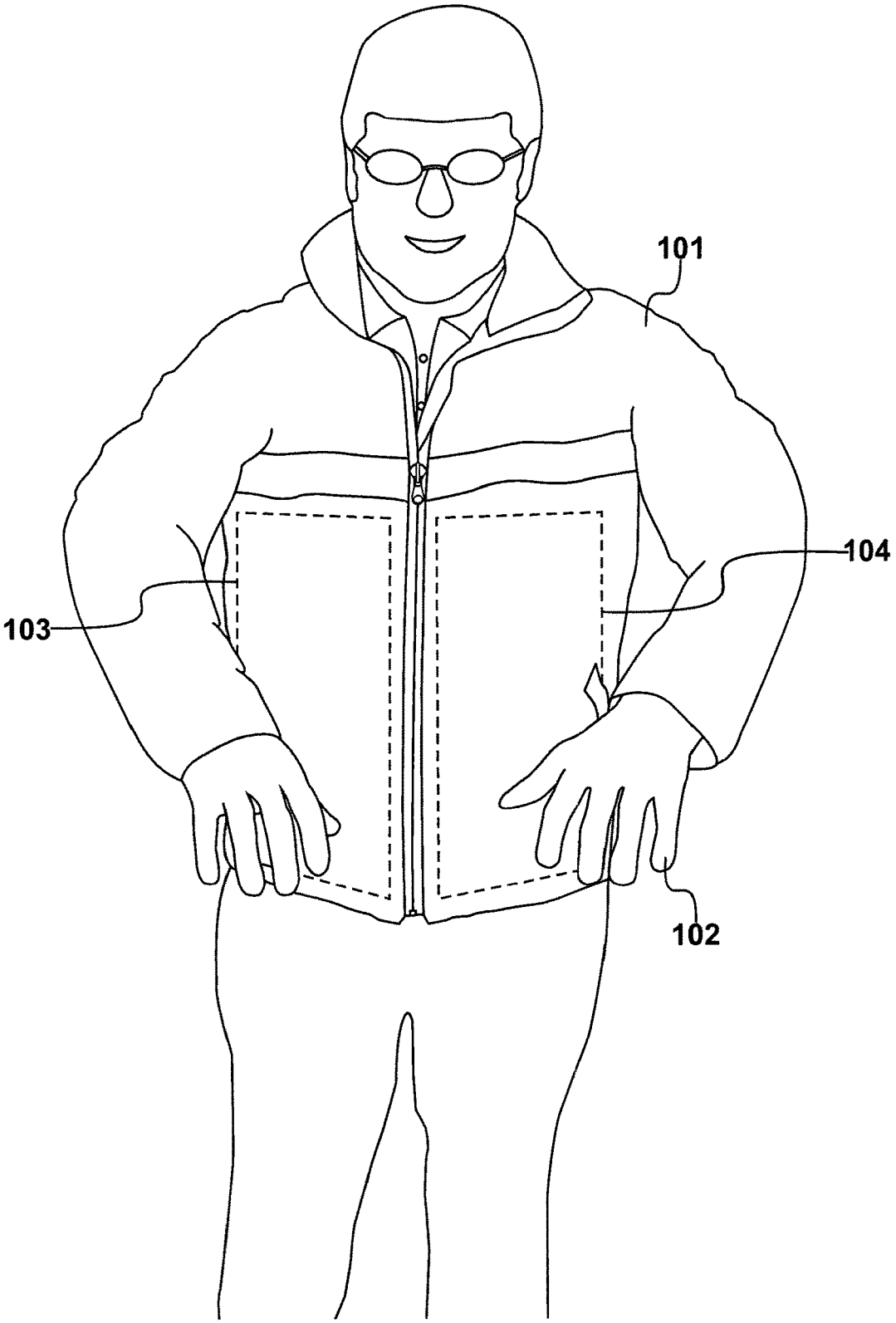
FIG. 1 shows a heated article comprising a conductive transfer in accordance with the invention.

A heated article comprising a conductive transfer in accordance with the present invention is shown with respect to FIG. 1. Heated article 101, in the form of a wearable item, is, in this illustrated example, a jacket. Jacket 101 appears substantially similar to conventional jackets and can be worn by user 102 in a substantially similar manner. However, jacket 101 comprises a conductive transfer therein and this provides heated functionality to user 102. Thus, in this way, user 102 can receive additional warmth from the conductive transfer therein to maintain their body temperature at a required level, even in colder climates.

In the embodiment, two conductive transfers 103 and 104, which are substantially similar to each other, are embedded within the lining of jacket 101 to enable heat to be provided to user 102. In this embodiment, conductive transfer 103 and conductive transfer 104 are positioned across the front portion of jacket 101 so as to provide heat to user 102's torso. In alternative embodiments, any suitable number of conductive transfers may be utilised within jacket 101 and may also be positioned on alternative parts of jacket 101, such as in the sleeves or on the back portion to provide heat as required.

It is noted that the conductive transfer of the present invention provides the wearable item with an electrical means to provide additional heat while being worn. The wearable item of FIG. 1 does not, however, suffer from traditional disadvantages of currently available heated jackets, in that the conductive transfer is constructed in such a way as to provide a lightweight, flexible alternative to wired versions, which is also washable and easier to manufacture as will be described further. For example, for a conductive transfer of the type described herein having dimensions of approximately thirty centimetres by thirty centimetres square (30 cm×30 cm), the overall mass is approximately fifteen grams (15*g*).

Wearable item 101 is shown in the illustrated embodiment as a jacket, however, it is appreciated that any other suitable wearable item may incorporate a substantially similar conductive transfer or a plurality of conductive transfers. Further examples include, but are not limited to, hats, gloves, outdoor wear, suits and other items of clothing. It is further appreciated that such clothing may be suitable for use in industrial workplaces with extreme temperature conditions or may alternatively be manufactured for more conventional uses such as a lightweight alternative to a heavy jumper or sweater.

Typically, any such wearable item comprises any suitable type of fabric typically used in the clothing industry including cottons, nylon, polyesters and/or waterproof materials. When forming part of a wearable item these materials are typically configured to be washable up to ninety-five degrees Celsius (95° C.) in line with conventional washing practices. It is appreciated that materials which can be washed at temperatures above and below ninety-five degrees Celsius (95° C.) are also used. Thus, the conductive transfer described herein is also configured to withstand conventional washing at these temperatures without any adverse effects to its functionality. In addition, a conductive transfer (103, 104) in accordance with the invention is configured to withstand elongation or stretching such that even when stretched a resistance is provided within a specified range such that the conductive capabilities of the conductive transfer do not degrade if the wearable item 101, and consequently conductive transfers 103 and 104, are stretched. In an embodiment, conductive transfers 103 and 104 each provide a resistance of at least twenty milliohms per square (10 mΩ/sq) at twenty-five microns (25 μm) or more.

By providing a flexible, stretchable, washable conductive transfer as part of a wearable item provides a number of advantages. In particular, the use of a conductive transfer as described herein has improved comfort for a wearer due to its lightweight properties and its ability to flex in a similar way to the fabric or other material to which it is attached. This also allows for wearable items to which the conductive transfer is applied to appear similar to conventional (non-heated) wearable items without affecting the shape of the wearable item.

In an alternative embodiment, a conductive transfer in accordance with the present invention is incorporated into other wearable items. In an example embodiment, such a conductive transfer is incorporated into a wearable item in the form of sportswear for an athlete, professional or otherwise. In particular, a heated conductive transfer forming part of the wearable item in this case can provide muscle warming which can improve athletic performances. It is appreciated that a similar wearable item could also be utilised to heat muscles or body parts for medical reasons such as back pain or muscle pain or any other medical condition.

FIG. 2

Figure 2:
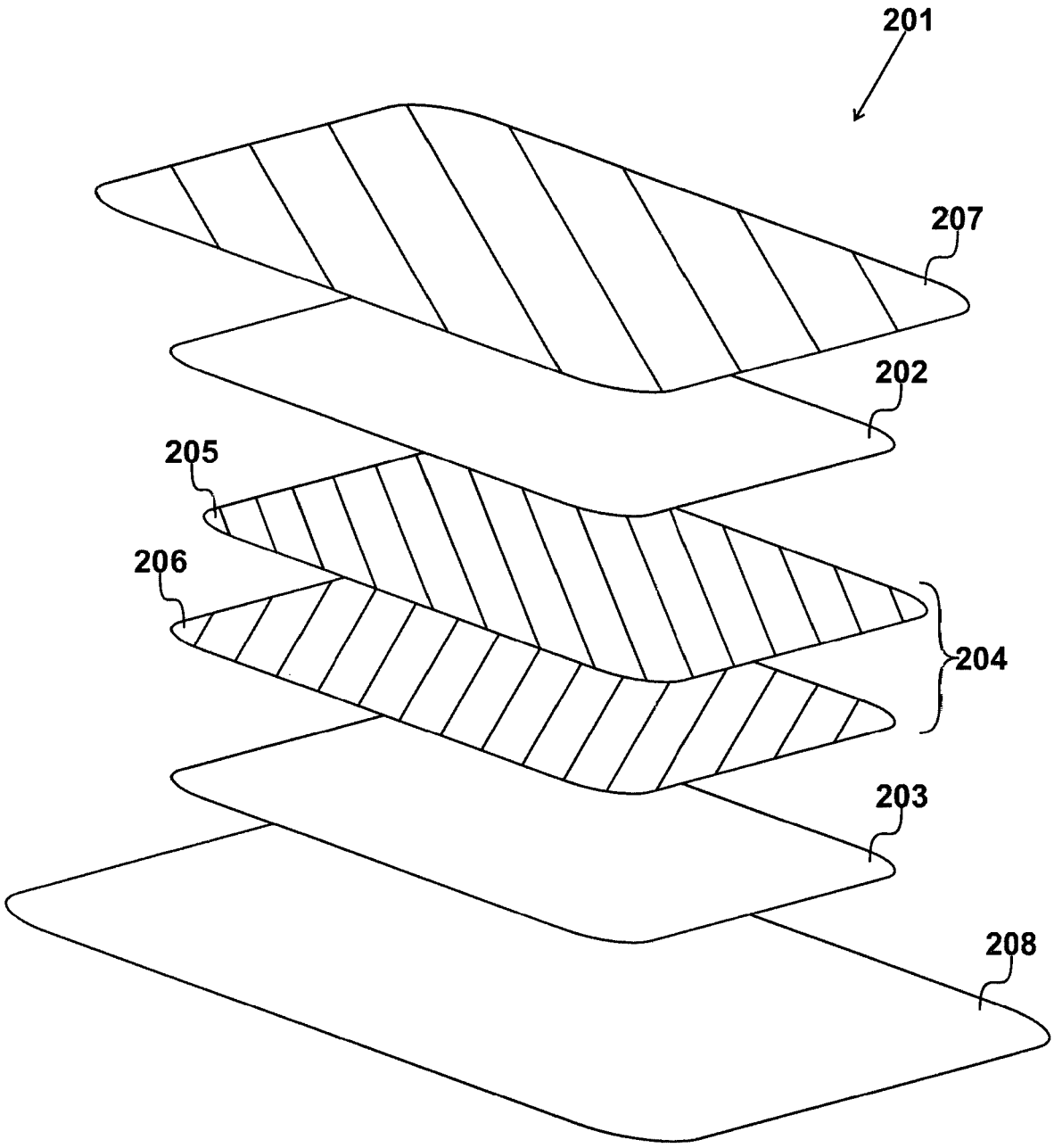
FIG. 2 shows an exploded schematic view of the layers of a heated conductive transfer.

FIG. 2 illustrates an exploded schematic view of the layers of a conductive transfer 201 in accordance with the present invention. Conductive transfer 201 is functionally similar to conductive transfers 103 and 104 as shown previously in FIG. 1.

In the embodiment, conductive transfer 201 comprises five layers and a substrate, as will now be described. Conductive transfer 201 comprises a first non-conductive ink layer 202 and a second non-conductive ink layer 203. The two non-conductive ink layers 202 and 203 are substantially similar in regards to their composition with each comprising a suitable printing ink which provides an encapsulant for a heating element. The non-conductive ink which forms the ink layer may comprise a water-based printing ink, an ultraviolet cured printing ink, a solvent based ink or a latex printing ink. Any other printing ink may be used in alternative embodiments.

Between non-conductive ink layer 202 and non-conductive ink layer 203, a heating element 204 is positioned. In the embodiment, heating element 204 comprises first and second electrically conductive ink layers 205 and 206. In the embodiment, electrically conductive ink layer 205 comprises an electrically conductive ink having a positive temperature coefficient such that the electrically conductive ink exhibits an increase in resistance in response to an increase in temperature. In the embodiment, the electrically conductive ink having a positive temperature coefficient comprises a carbon-based ink. It is appreciated that, in alternative embodiments, heating element 204 may comprise a larger number of layers or a single layer of material. However, in each embodiment, heated element includes an electrically conductive ink having a positive temperature coefficient.

Electrically conductive ink layer 206 comprises a metallic material which is provided in the form of an ink. In an embodiment, the metallic material comprises a silver-based ink. In a further embodiment, the metallic material comprises a copper-based ink. In the embodiment, when conductive transfer 201 is formed, heating element 204 and electrically conductive ink layer 206 is encapsulated by non-conductive ink layers 202 and 203. Thus, in this way, a copper-based ink can be advantageous over a silver-based ink as the encapsulation reduces the problems typically experienced with oxidisation of copper inks. In addition, a copper-based ink is also commercially advantageous as a copper-based ink is substantially cheaper than suitable silver inks. In further embodiments, it is appreciated that other metallic-based inks may be utilised.

In an alternative embodiment to that shown in FIG. 2, heating element 204 further comprises an additional electrically conductive layer to provide a resistive layer which is positioned in an electrically parallel arrangement with electrically conductive ink layer 205. This resistive layer consequently performs in the manner of a resistor in parallel thereby reducing the resistance across the positive temperature coefficient ink allowing the heated transfer to heat up at an increased rate such that the maximum temperatures are reached over as short a period of time as possible. In this embodiment, the additional electrically conductive layer comprises a carbon-based ink.

Conductive transfer 201 further comprises an adhesive layer 207 which is suitable for adhering conductive transfer 201 to a suitable surface. In the embodiment of FIG. 1, the surface is a fabric forming part of wearable item 101. It is appreciated that conductive transfer 201 is configured to be applied to any suitable surface, not limited to fabrics, and includes surfaces comprising plastics, ceramics or wood.

In the embodiment, the adhesive layer comprises any suitable adhesive, including, but not limited to a water-based adhesive, a solvent-based adhesive, a printable adhesive, a powder adhesive or any other suitable adhesive which is capable of adhering conductive transfer 201 to any of the aforementioned surfaces. In one embodiment, adhesive layer 207 comprises a printable adhesive which is substantially transparent. This type of adhesive is able to withstand higher temperatures compared to available powder adhesives and is also suitable for use on coloured surfaces without being substantially visible to the human eye. It is also anticipated that any suitable adhesive would also be compliant with standard washing practices of up to ninety-five degrees Celsius (95° C.) as previously discussed. It is appreciated that, in alternative embodiments, non-transparent adhesives are used which are capable of adhering the conductive transfer to a surface.

In manufacture, as will be described with respect to FIGS. 11 to 15, each of the layers are printed onto a substrate 208. Substrate 208 is configured to be removable from the remaining layers by means of an application of heat, pressure or a combination of heat and pressure. Thus, when applied, adhesive layer 207 is brought into contact with the surface to which conductive transfer is to be applied, and heat and/or pressure is applied to substrate 208 such that adhesive layer 207 adheres conductive transfer 201 to the surface.

In the embodiment, substrate 208 is a polyester film. In an alternative embodiment, substrate 208 comprises a paper film, coated paper or TPU (thermoplastic polyurethane).

FIG. 3

One-dimensional printed views of an example pattern for the non-conductive ink layers and electrically conductive layers of conductive transfer 201 to provide a heated transfer will now be illustrated with respect to FIGS. 3 to 6. It is appreciated that the invention is not limited to the pattern illustrated and that other suitable patterns may be printed to form a conductive transfer in accordance with the invention.

Figure 3:
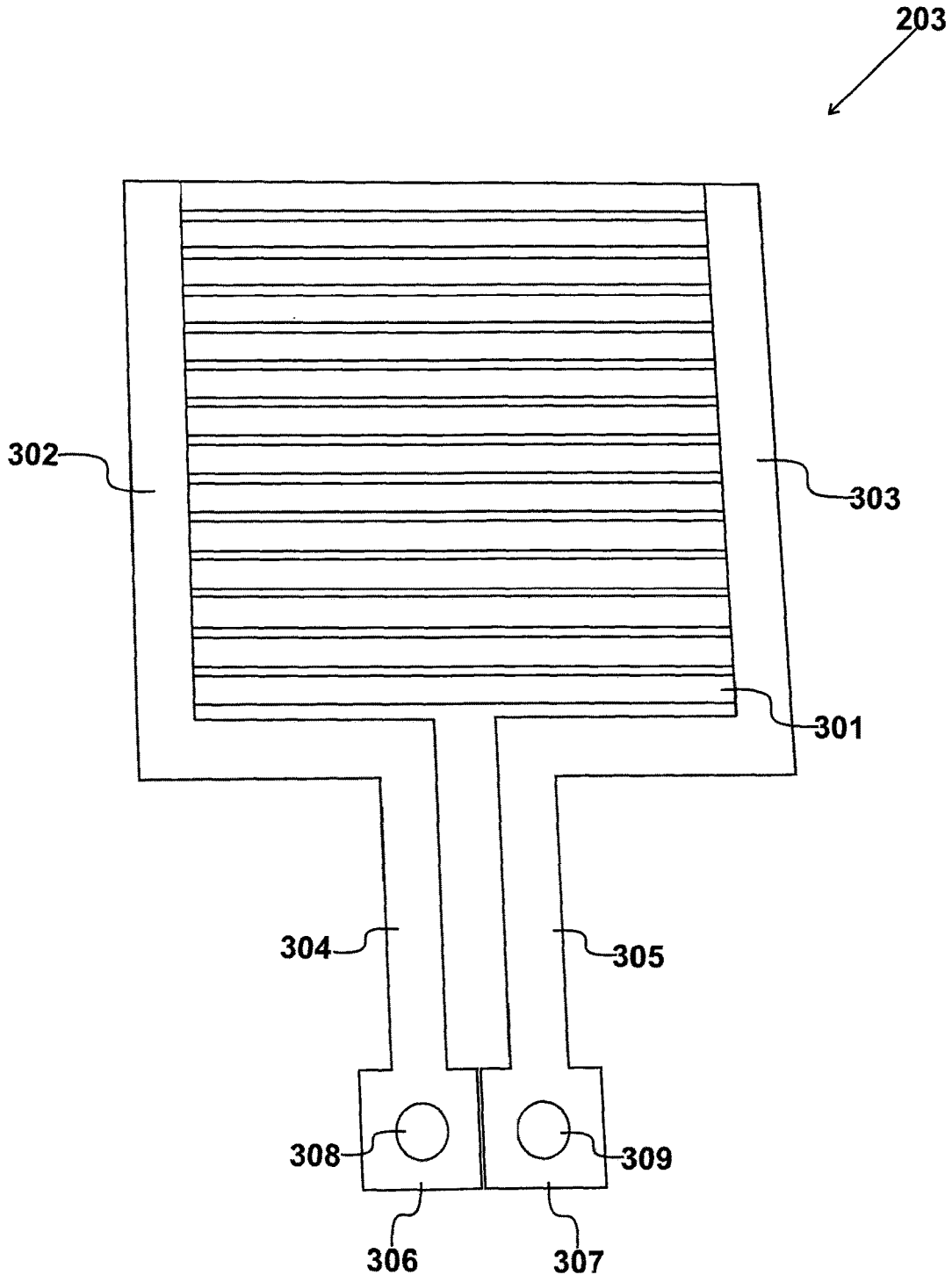
FIG. 3 shows an example printed pattern for a non-conductive ink layer of the conductive transfer of FIG. 2.

An example printed pattern for non-conductive ink layer 203 is shown in FIG. 3. In the embodiment, non-conductive ink layer 203 is printed utilising a suitable printing ink as a design comprising a plurality of bars 301 which are arranged parallel to each other and spaced apart from each other. Each of the bars 301 extend between a first end portion 302 and a second end portion 303 which form a broken 'C' shaped print which extends by means of extending portions 304 and 305 to connection points 306 and 307. Each of the connection points 306 and 307 provide a pattern in which non-printed areas 308 and 309 are included which can be utilised to create electrical connection points which will be described further with respect to FIGS. 7 and 8.

FIG. 4

Figure 4:
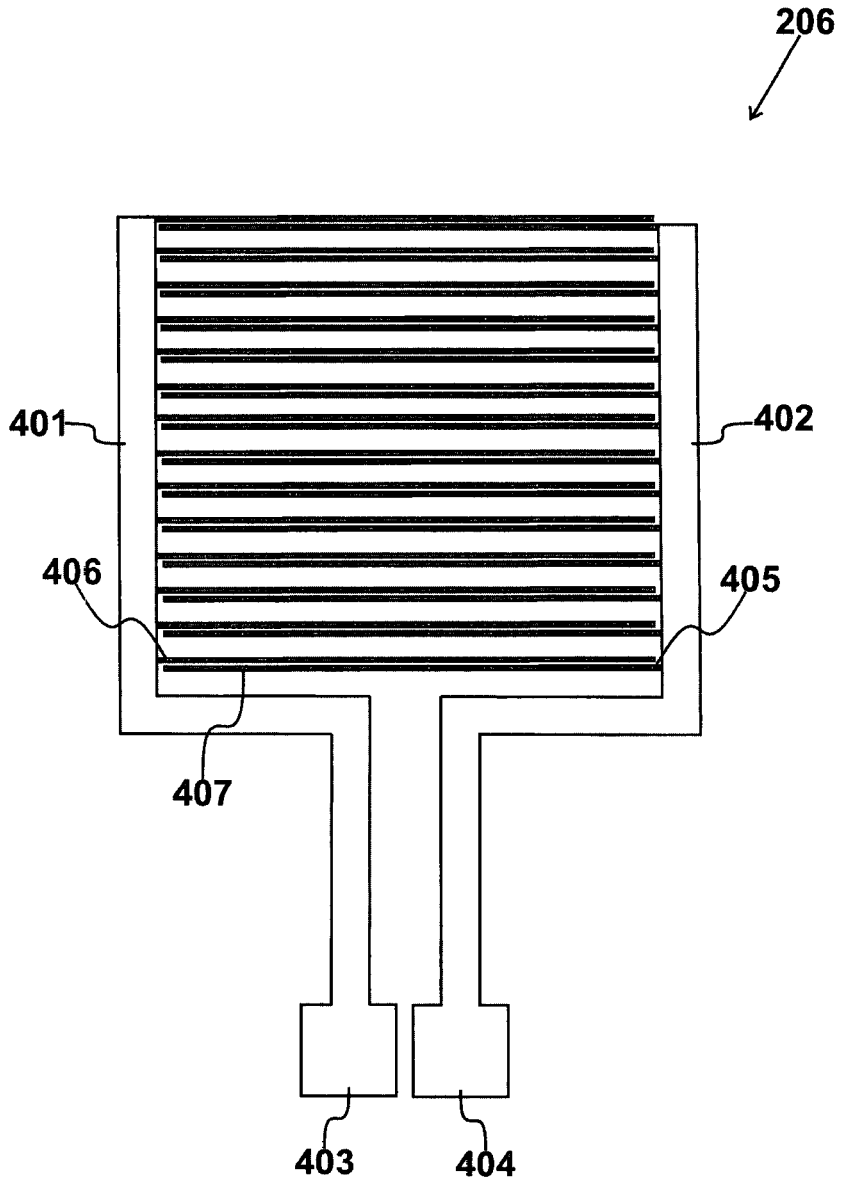
FIG. 4 shows a corresponding example printed pattern for an electrically conductive ink layer comprising a metallic material.

An example printed pattern for electrically conductive ink layer 206 comprising a metallic material is shown in FIG. 4. In manufacture, electrically conductive ink layer 206 is over-printed over non-conductive ink layer 203 as part of the process for forming conductive transfer 201.

Electrically conductive ink layer 206 comprises an arrangement of a first end portion 401 and a second end portion 402 which form a broken 'C' shaped print substantially similar to the pattern of non-conductive ink layer 203 shown in FIG. 3. Electrically conductive ink layer 206, however, does not include non-printed areas in the connection points 403 and 404 meaning that, when printed, the metallic material of electrically conductive ink layer 206 is exposed through non-printed areas 308 of non-conductive ink layer 203.

The pattern of electrically conductive ink layer 206 also comprises a plurality of interdigitated fingers 405. Interdigitated finger 405 comprises two fingers 406 and 407. In the embodiment, finger 406 extends from end portion 401 towards end portion 402 but does not touch the print of end portion 402. Similarly, finger 407 extends from end portion 402 towards end portion 401 but does not touch the print of end portion 401. In this way, an electrical circuit can only be completed with electrically conductive layer 206 by combining electrically conductive layer 206 with a further electrically conductive layer.

In the embodiment, electrically conductive ink layer 206 comprises a metallic material and, in one embodiment, the metallic material comprises silver or a silver-based ink. In a further embodiment, the metallic material comprises copper or a copper-based ink.

Once constructed as part of conductive transfer 201, first end portion 401 and second end portion 402 comprise a track which receives high volumes of current via connection points 403 and 404. In order to account for the high current input, in an embodiment, electrically conductive ink layer 206 further comprises one or more additional ink layers comprising the pattern of end portion 401, end portion 402 and connection points 403 and 404. These additional ink layers are printed over the pattern shown in FIG. 4 such that end portions 401 and 402 and connection points 403 and 404 comprise an increased thickness compared to the interdigitated fingers 405. This increased thickness through the layer ensures that the conductive transfer is able to withstand the high current input required in the application.

During printing, this arrangement is advantageous in respect of the positive temperature coefficient ink layer 205 as will be described in FIG. 5.

FIG. 5

Figure 5:
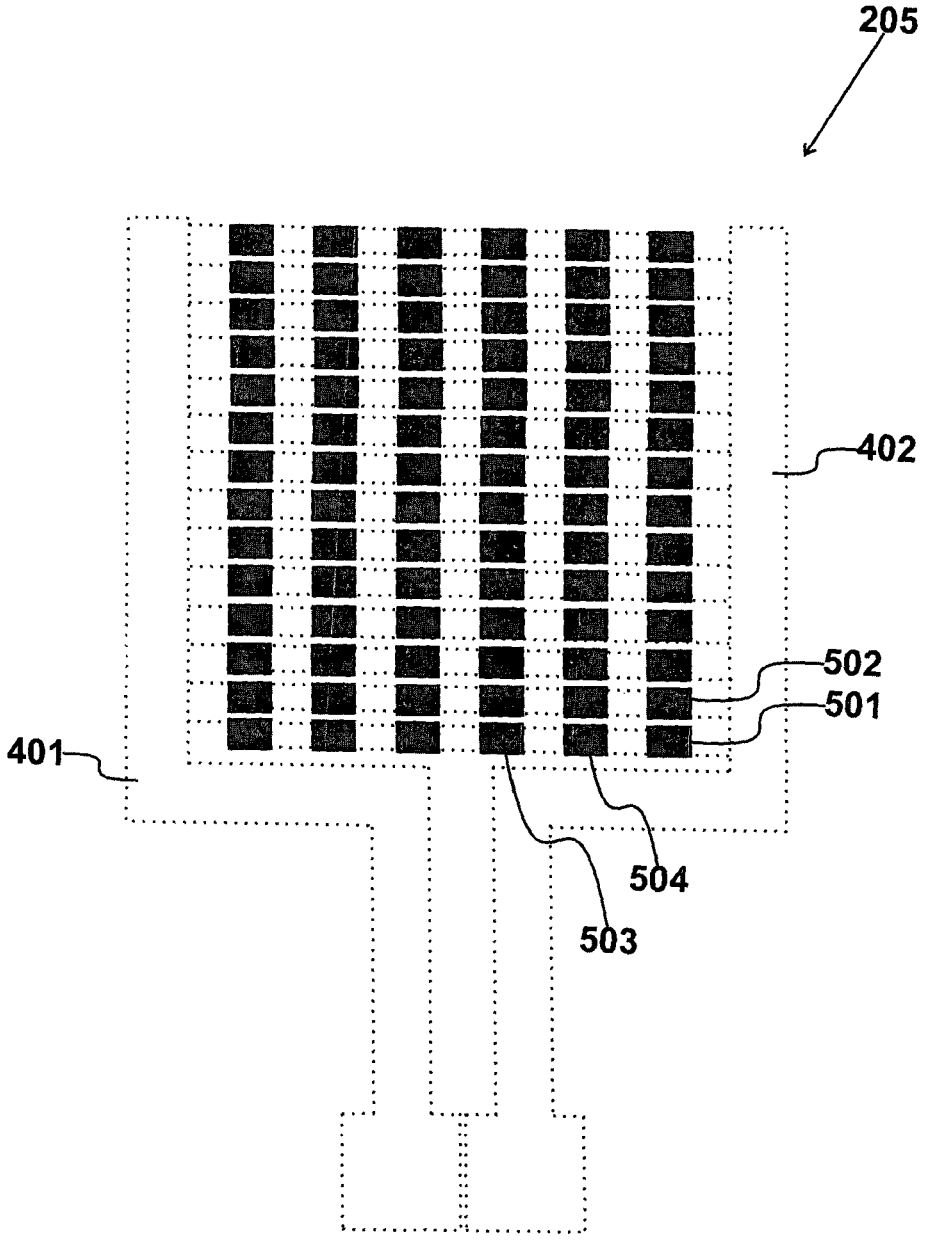
FIG. 5 shows a corresponding example printed pattern for an electrically conductive ink layer having a positive temperature coefficient.

An example printed pattern for electrically conductive ink layer 205 comprising a positive temperature coefficient ink is shown in FIG. 5. In manufacture, electrically conductive ink layer 205 is over-printed over electrically conductive ink layer 206 as part of the process for forming conductive transfer 201.

In contrast to the interdigitated fingers of electrically conductive ink layer 206, electrically conductive ink layer 205 comprises a plurality of rows, such as rows 501 and 502, which are spaced apart and arranged in a grid format. When overprinted over electrically conductive ink layer 206, each of the rows are configured to extend between end portions 401 and 402. It is appreciated that substantially similar end portions or corresponding connection points are not printed as part of electrically conductive ink layer 205, and that the end portions shown in FIG. 5 are illustrated as dashed lines to indicate their relative positioning in respect of electrically conductive ink layer 206. The plurality of rows 201, 502 form a plurality of busbars having a larger thickness than the interdigitated fingers of electrically conductive layer 206 such that, when electrically conductive ink layer 205 is printed over electrically conductive ink layer 206, an electrical circuit is completed.

In the embodiment, each of the busbars 501 comprise a plurality of positive temperature coefficient ink elements, such as elements 503 and 504. Each positive temperature coefficient ink element is electrically connected in parallel by means of the corresponding interdigitated fingers of electrically conductive ink layer 206 as each positive temperature coefficient ink element overlaps the interdigitated fingers to provide a connection to end portion 401 and end portion 402.

A plurality of positive temperature coefficient ink elements is advantageous in this embodiment as, in use, as the positive temperature coefficient ink elements reach a predetermined temperature, the molecules in the ink separate and the resistance through the ink reduces. By providing an arrangement of a larger number of smaller elements, the elements may reach this temperature threshold at different intervals, meaning the temperature output from the conductive transfer remains substantially similar to a user, for example, a wearer of a wearable item in line with that described in FIG. 1. A further advantage is that by utilising a plurality of positive temperature coefficient elements the conductive transfer has improved stretchability in comparison to conventional heating elements. While it is appreciated that the busbar on each row may comprise a single positive temperature coefficient element, it is preferable to include a plurality for this reason.

In the embodiment, electrically conductive ink layer 205 comprises a carbon-based ink and, in particular, the carbon-based ink has a positive temperature coefficient as will be explained in further detail in FIG. 9.

As noted in FIG. 4, in the embodiment additional ink layers provide an increased thickness of end portions 401 and 402 and connection points 403 and 404, when electrically conductive ink layer 205 is printed, this avoids the need to achieve precise alignment between the two layers as electrically conductive ink layer 205 automatically aligns into the area of interdigitated fingers due to the added thickness of surrounding end portions 401 and 402. This avoids issues with interlayer alignment across the thickness.

In an embodiment, first end portion 401 and second end portion 402 of electrically conductive ink layer 206 shown in FIG. 4, along with the connection points 403 and 404 are printed on a first layer and the plurality of interdigitated fingers 407 are printed on a second layer which in combination provide the electrically conductive ink layer 206. Positive temperature coefficient ink elements may then be printed over portions 401 and 402 thereby avoiding any potential cold spots across the heated transfer. Consequently, this provides a multilayer heater without substantially increasing the size or weight of the transfer.

FIG. 6

Figure 6:
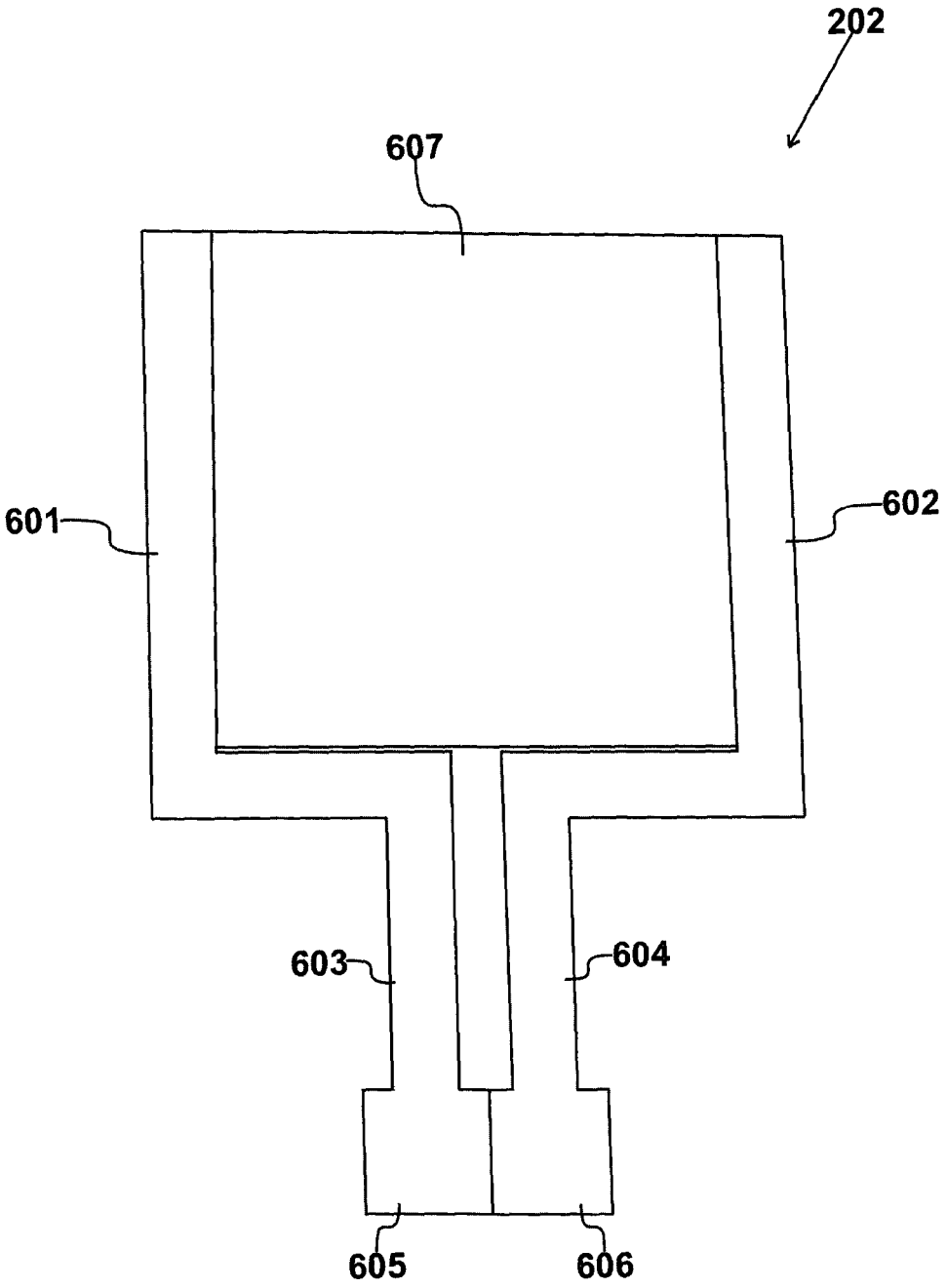
FIG. 6 shows a corresponding example printed pattern for non-conductive ink layer of the conductive transfer of FIG. 2.

An example printed pattern for non-conductive ink layer 202 is shown in FIG. 6. In the embodiment, non-conductive ink layer 202 is printed utilising a suitable printing ink which is substantially similar to the printing ink utilised for non-conductive ink layer 203. In manufacture, electrically conductive ink layer 202 is over-printed over electrically conductive ink layer 205 as part of the process for forming conductive transfer 201.

The pattern of non-conductive ink layer 202 comprises a larger area of non-conductive ink than non-conductive ink layer 203. Non-conductive ink layer 202 includes a substantially similar arrangement of a first end portion 601 and a second end portion 602 which form a broken 'C' shaped print and extending portions 603 and 604. Again, non-conductive ink layer 202 does not include non-printed areas in the connection points 605 and 606. Further, instead of providing bars or fingers, an encapsulating block 607 is printed. Thus, it can be seen that non-conductive ink layer 202 is substantially encapsulating of the other layers in conductive transfer 201.

FIG. 7

Figure 7:
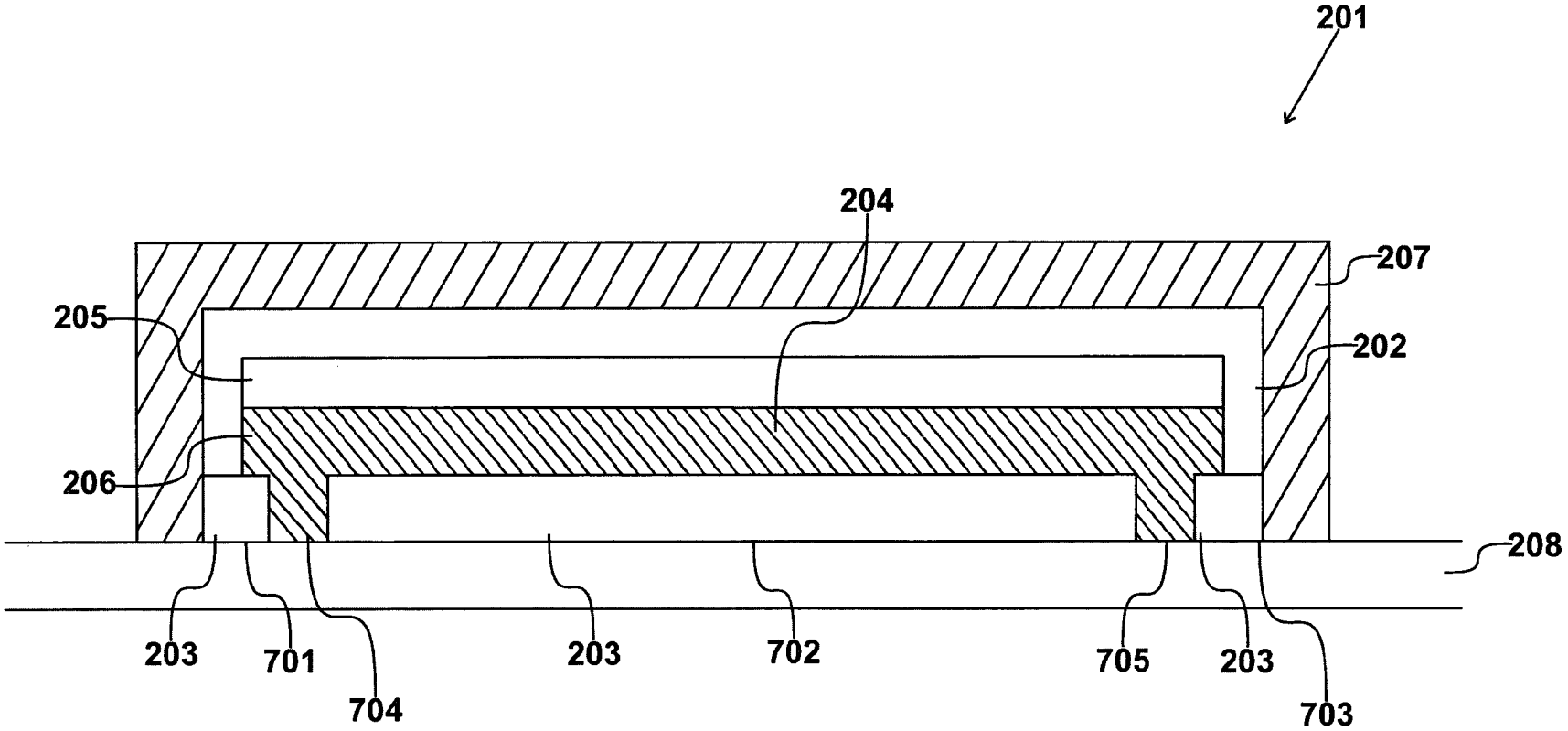
FIG. 7 shows a cross-sectional schematic view through the conductive transfer.

A cross-sectional view through conductive transfer 201 through the connection points once all layers have been printed is shown in FIG. 7. It is appreciated that the cross-sectional view is schematic in nature and is not to scale. In practice, conductive transfer 201 is typically around one hundred and seventy micrometres (170 μm) in thickness through the layer from the top edge of substrate 208 to the top edge of adhesive layer 207. In an embodiment, each printed non-conductive ink layer is approximately thirty micrometres (30 μm) in thickness with the heating element having a thickness of around thirty-seven micrometres (37 μm). In particular, the positive temperature coefficient ink layer 205 has a thickness of approximately twenty-five micrometres (25 μm) while electrically conductive ink layer 206 having a thickness of approximately twelve micrometres (12 μm). Adhesive layer 207 is approximately seventy micrometres (70 μm) of the full thickness. When applied to a textile substrate, for example, the thickness of the adhesive layer is reduced as the adhesive is significantly absorbed by surrounding textile. Thus, the total thickness of the conductive transfer once applied to a material is in the region of one hundred micrometres (100 μm). It is appreciated that in embodiments, however, conductive transfer 201 may be any other suitable thickness.

The drawing illustrates conductive transfer 201 ready to be applied to a surface when all ink layers have been printed onto substrate 208.

As previously noted, conductive transfer 201 comprises first and second non-conductive ink layers 202 and 203. Given the nature of the printed patterns described with respect to FIG. 3 in particular, non-conductive ink layer 203 is shown to comprise a single layer in which spaces are present.

As can be seen from the illustrated cross-section, heating element 204 is therefore encapsulated between non-conductive ink layer 202 and non-conductive ink layer 203 across areas 701, 702 and 703 across a plane parallel to substrate 208. Electrical connection points 704 and 705 are then provided between the spaces in non-conductive ink layer 203 due to the exposure of electrically conductive ink 206 of heated element 204 across these spaces which are present in a plane parallel to substrate 208.

It is further noted that, in particular, the positive temperature coefficient electrically conductive ink layer 205 is encapsulated by electrically conductive layer 206 and non-conductive ink layer 202 as is not directly exposed to the atmosphere once substrate 208 has been removed.

The encapsulation of the positive temperature coefficient electrically conductive ink layer 205 ensures protection of the electrically conductive ink layer such that conductive transfer, for example, can be washed at high temperatures without damage to the heating element.

In addition, in an embodiment in which the electrically conductive ink layer 206 comprises a copper ink, the encapsulation prevents oxidisation of the ink when in use. In this embodiment, an additional seal is printed over electrical connection points 704 and 705 to ensure prevention of the oxidisation.

FIG. 8

Figure 8:
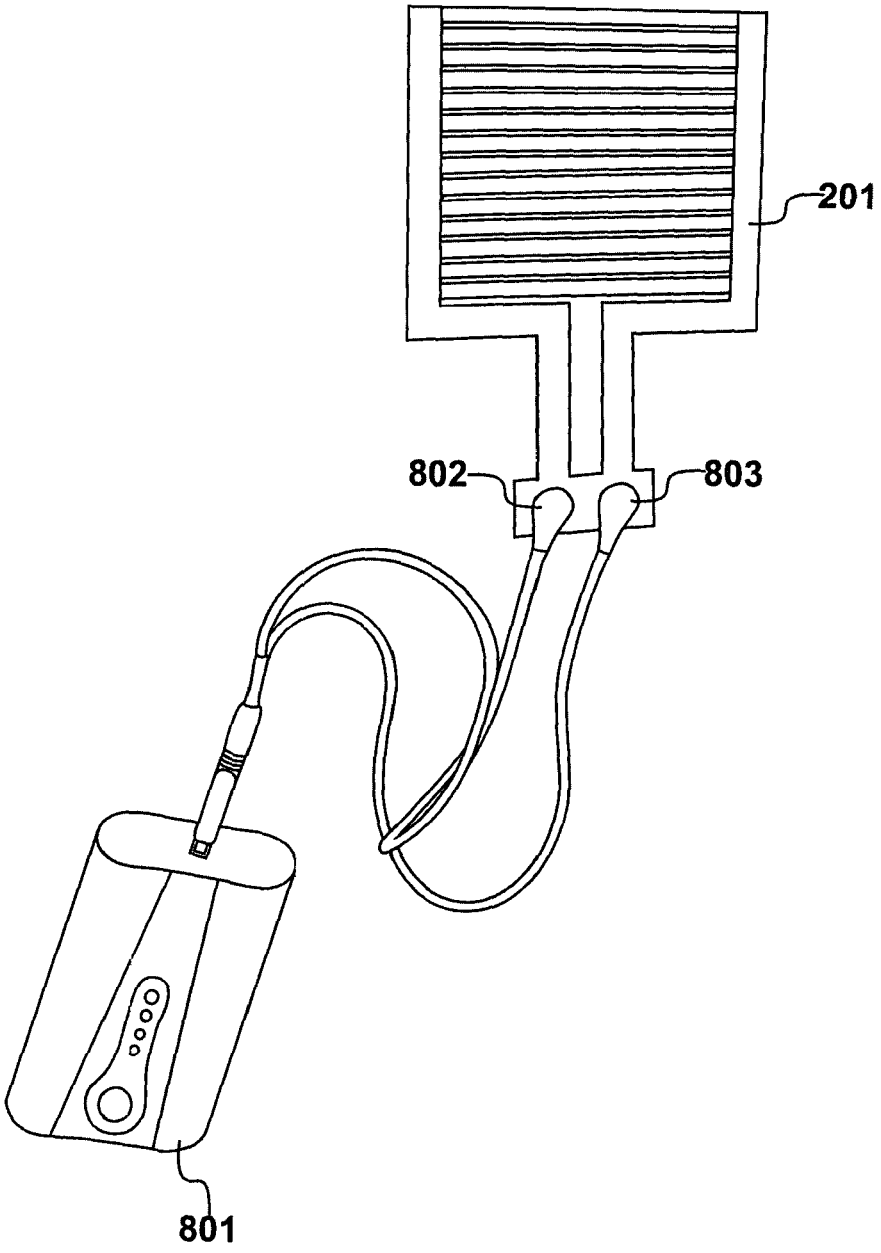
FIG. 8 shows the conductive transfer in a heating application.

Once printed, an application of heat and/or pressure can be applied to conductive transfer 201 to apply conductive transfer 201 to a suitable surface such as a fabric or any other required surface as indicated previously. Once heat and pressure has been applied, substrate 208 is removed and conductive transfer 201 can be utilised in a heating application, as shown in FIG. 8. Thus, in the embodiment of FIG. 8, conductive transfer 201 does not comprise substrate 208, and, in use therefore, conductive transfer 201 does not require a substrate to be present.

In the embodiment, conductive transfer 201 further comprises a power source 801. Power source 801 is configured to enable power to be provided to heating element 204. When power is supplied to heating element 204, heating element 204 is configured to increase in temperature and provide a temperature output.

In the embodiment, power source 801 comprises a rechargeable battery which is connected by means of electrical connectors 802 and 803 which are fitted to electrical connection points 704 and 705.

In the embodiment, power source 801 is configured to operate at a plurality of power levels which can be chosen by a user and which allows for the temperature output to be varied accordingly. In an embodiment, the rechargeable battery comprises a lithium ion battery. It is appreciated however, that other suitable power sources and batteries may be utilised.

In an alternative embodiment, power source 801 comprises a printed ink. In this embodiment, the printed ink provides a printed battery. Typically, this includes two additional layers of ink comprising compositions, which, when brought into contact, act as a power source. This embodiment allows for the entire conductive transfer to be printed leading to improved weight advantages and easier manufacture.

In an embodiment, power source 801 provides a direct current (DC) supply. In an alternative embodiment, power source 801 provides an alternating current (AC) supply. The utilisation of an AC power supply may be utilised to address problems with electromigration which can occur with repeated use. As a further alternative to address the same issue, the power source may be provided with a switch which is configured to automatically switch the polarity each time the power is switched on or at a predetermined time interval. This can also reduce the impact of electromigration.

FIG. 9

Figure 9:
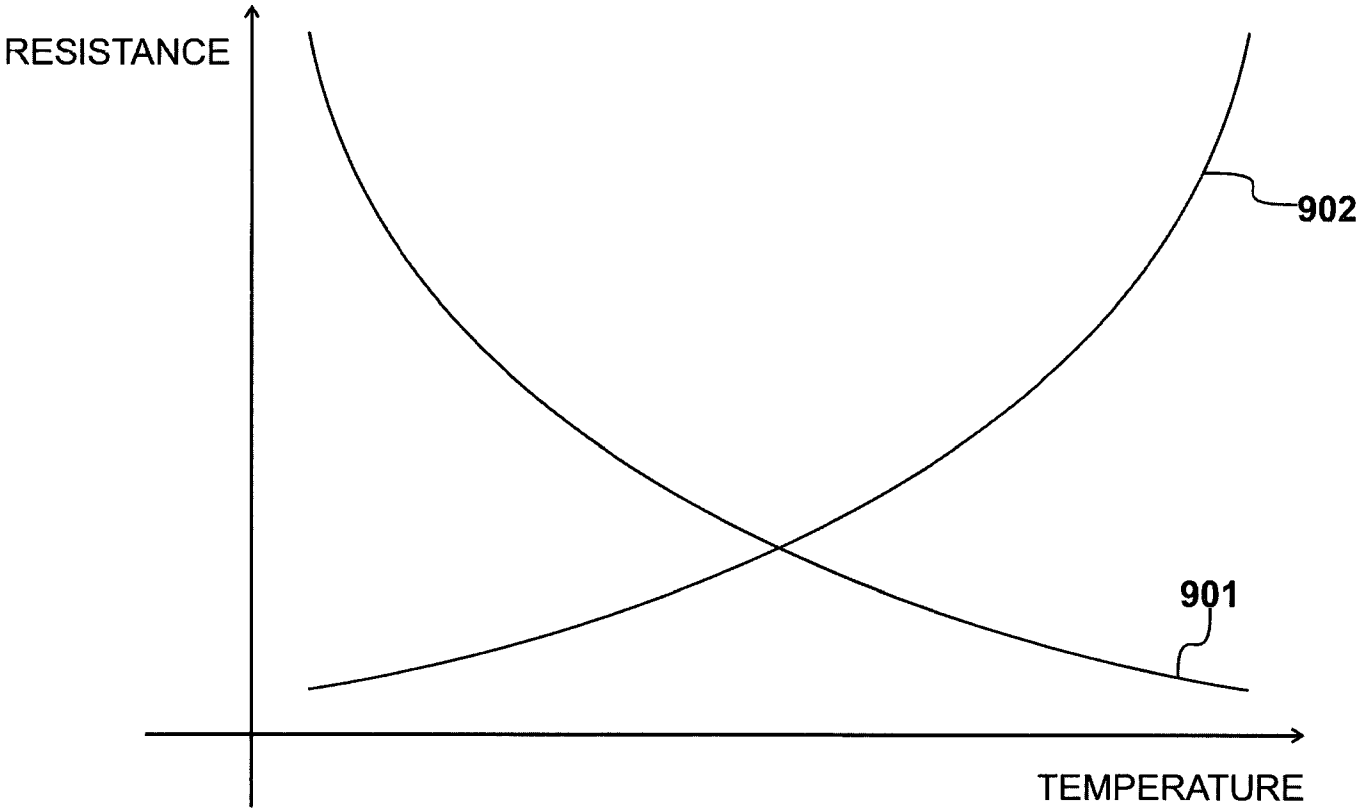
FIG. 9 shows a graph of resistance against temperature of the positive temperature coefficient electrically conductive ink.

A graph illustrating the functionality of the positive temperature coefficient electrically conductive ink is shown in FIG. 9. A plot of resistance against temperature is shown. Line 901 shows the response of a conventional conductive ink of the type conventionally used in conductive transfers. In this respect, as the temperature of the conductive ink increases, the resistance drops exponentially.

In contrast, with respect to the positive temperature coefficient electrically conductive ink, with an increase in temperature, the resistance of the ink also increases. At an atomic level, the molecules in a positive temperature coefficient electrically conductive ink are configured to separate with increasing temperature. This in turns leads the resistance to electric current to increase, which in turn causes the electrically conductive ink to cool. As the ink cools, the separation between the molecules reduces, which allows the resistance to decrease, thereby increasing current flow and providing a heat output. In this way, the heat is regulated and a consistent output is provided without overheating or risk to a user.

As previously indicated, the positive temperature coefficient electrically conductive ink utilised in the embodiment is a carbon-based ink. In the application described in FIG. 1, the positive temperature coefficient electrically conductive ink is selected as one having a peak temperature output of up to forty degrees Celsius (40° C.). Thus, in the example, the heated wearable article has an output temperature of between thirty and forty degrees Celsius (30-40° C.). In alternative embodiments, alternative positive pressure temperature coefficient inks can be selected that have different operating temperatures as required.

FIG. 10

Figure 10:
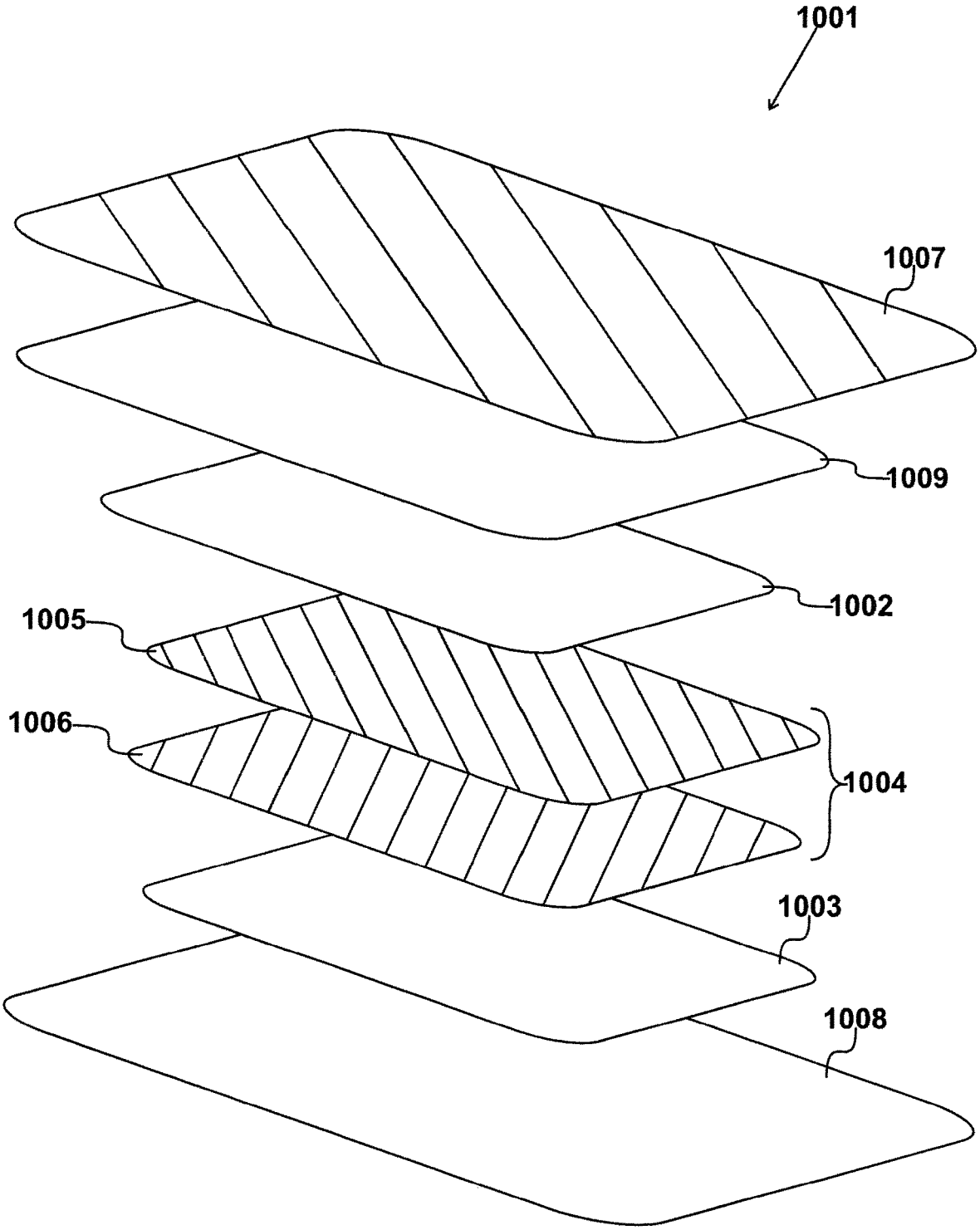
FIG. 10 shows a conductive transfer in accordance with an alternative embodiment of the present invention.

A conductive transfer 1001 in an alternative embodiment in accordance with the present invention is shown in FIG. 10. Conductive transfer 1001 is shown, like FIG. 2, in an exploded schematic form.

Conductive transfer 1001 is substantially similar to conductive transfer 201 in that conductive transfer 1001 comprises a first non-conductive ink layer 1002 and a second non-conductive ink layer 1003. Conductive transfer 1001 further comprises a heating element 1004 which similarly comprises first and second electrically conductive ink layers 1005 and 1006. Again, in the embodiment, electrically conductive ink layer 1005 comprises an electrically conductive ink having a positive temperature coefficient such that the electrically conductive ink exhibits an increase in resistance in response to an increase in temperature. In these respects, each of the layers are substantially similar to those of conductive transfer 201. Conductive transfer 1001 also comprises a substantially similar adhesive layer 1007 which is suitable for adhering conductive transfer 1001 to a suitable surface. Additionally, each of the layers are printed onto a substantially similar removable substrate 1008.

Conductive transfer 1001, however, also comprises an insulating layer 1009. Insulating layer 1009 is configured to provide additional insulation to heating element 1004 such that heat is retained on one side of conductive transfer 1001. Using the embodiment of FIG. 1 as an example, insulating layer 1009 is positioned between non-conductive ink layer 1002 and adhesive layer 1007. Thus, when applied to a wearable item and with substrate 1008 removed, when heated jacket 101 is worn by a user, insulating layer 1009 provides an additional layer facing outwards in order to direct heat towards the user and maintain a required temperature. In an alternative embodiment, insulating layer 1009 is positioned between non-conductive ink layer 1002 and heating element 1004.

In an embodiment, insulating layer 1009 comprises an impermeable material to ensure heat is not transferred. In an alternative embodiment, insulating layer 1009 comprises a layer comprising a reflective material and a layer comprising an insulating material. The reflective material may comprise a reflective ink, and in an embodiment, the reflective ink comprises reflective beads. In each case it is appreciated that, where possible, the insulating layer is printed as part of the printing process for creation of the conductive transfer. However, it is also appreciated that, in other embodiments, the layer may be attached as a separate non-printed element, such as a separate sheet or fabric layer.

In an embodiment, an air gap is included between insulating layer 1009 and non-conductive ink layer 1002. This assists in providing further insulation so that heat is directed accordingly.

FIG. 11

A method of producing a conductive transfer as previously described, such as conductive transfers 201 or 1001, will now be described with reference to FIGS. 11 to 15.

The method will be described with respect to a screen printing process. It is appreciated however that as an alternative to screen printing, the method may be conducted by any other form of printing such as reel-to-reel printing, dot matrix printing, laser printing, cylinder press printing, ink jet printing, flexographic printing, lithographic printing, offset printing, digital printing, gravure printing or xerographic printing. It is further appreciated that the invention is not limited to these methods. In order to produce a conductive transfer as previously described an operative 1101 places a suitable substrate on 1102 onto a screen printing machine 1103. In this embodiment, the substrate comprises a sheet of polyester film which is any suitable size but may be for example A4, or A3 or larger sizes. It is further appreciated that when using reel-to-reel printing the film is provided from a roll of material rather than a sheet.

In the embodiment, screen printing machine 1103 is semi-automatic. The substrate 1102 is laid on a printing surface 1104 ready for ink to be provided through a screen 1105. Screen 1105 includes a mesh or stencil which illustrates the design, such as the electrical circuit design, to be printed.

FIG. 12

Ink is applied to screen 1105 as screen 1105 is lowered into contact with substrate 1102. A squeegee head 1201 moves across screen 1105 and pushes the appropriate ink onto the substrate in line with the design on the mesh.

It is appreciated that for each different design the mesh or stencil needs to be replaced and for each different type of ink the screen requires cleaning. Thus, in manufacture, each layer is batch printed before the next layer is printed over the top for each batch.

It is further appreciated that alternatives to the semi-automatic machine can be used such of those of the carousal type which are able to print several different inks at once. The semi-automatic system typically produces between around two hundred (200) sheets and two hundred and fifty (250) sheets per hour. For higher production, a fully automatic system is typically able to produce fifteen hundred (1500) sheets to two thousand (2000) sheets per hour.

FIG. 13

Once the appropriate layer has been printed onto the substrate 1102, substrate sheets indicated at 1301, 1302 and 1303, are processed through a curing machine 1304. In this embodiment, the curing machine comprises a dryer which provides a hot air flow onto sheets 1301, 1302 and 1303 to enable the inks to be cured effectively.

In the embodiment, the blown air temperature inside the dryer is typically set at one hundred and twenty degrees Celsius (120° C.) for three minutes for the non-conductive ink layers. For the electrically conductive ink layers forming the heating element the temperature is raised to typically one hundred and thirty degrees Celsius (130° C.) for three minutes. In the embodiment, the dryer used includes a three (3) metre drying section. It is appreciated that the temperatures indicated here are dependent on the curing system used and the temperatures indicated can be lower or higher depending on the system. In addition, the time taken to dry each sheet can also vary depending on the temperatures and also the length of the drying section.

This step is particularly important as in order to achieve the encapsulation of the electrically conductive layer, the non-conductive ink layers need to be solidified appropriately to avoid cross contamination of each of the layers.

Curing machine 1304 includes a conveyor 1305 which transports the cured sheets out of the machine 1304 and into a holding tray 1306. Thus, when all sheets of the batch have been completed, they can be collected for either the next application of the next layer or for application to a suitable surface of an article. Alternatively, it is appreciated that the completed sheets may be supplied to a customer such that the customer may apply the conductive transfers to their own surfaces and/or articles.

FIG. 14

Figure 14:
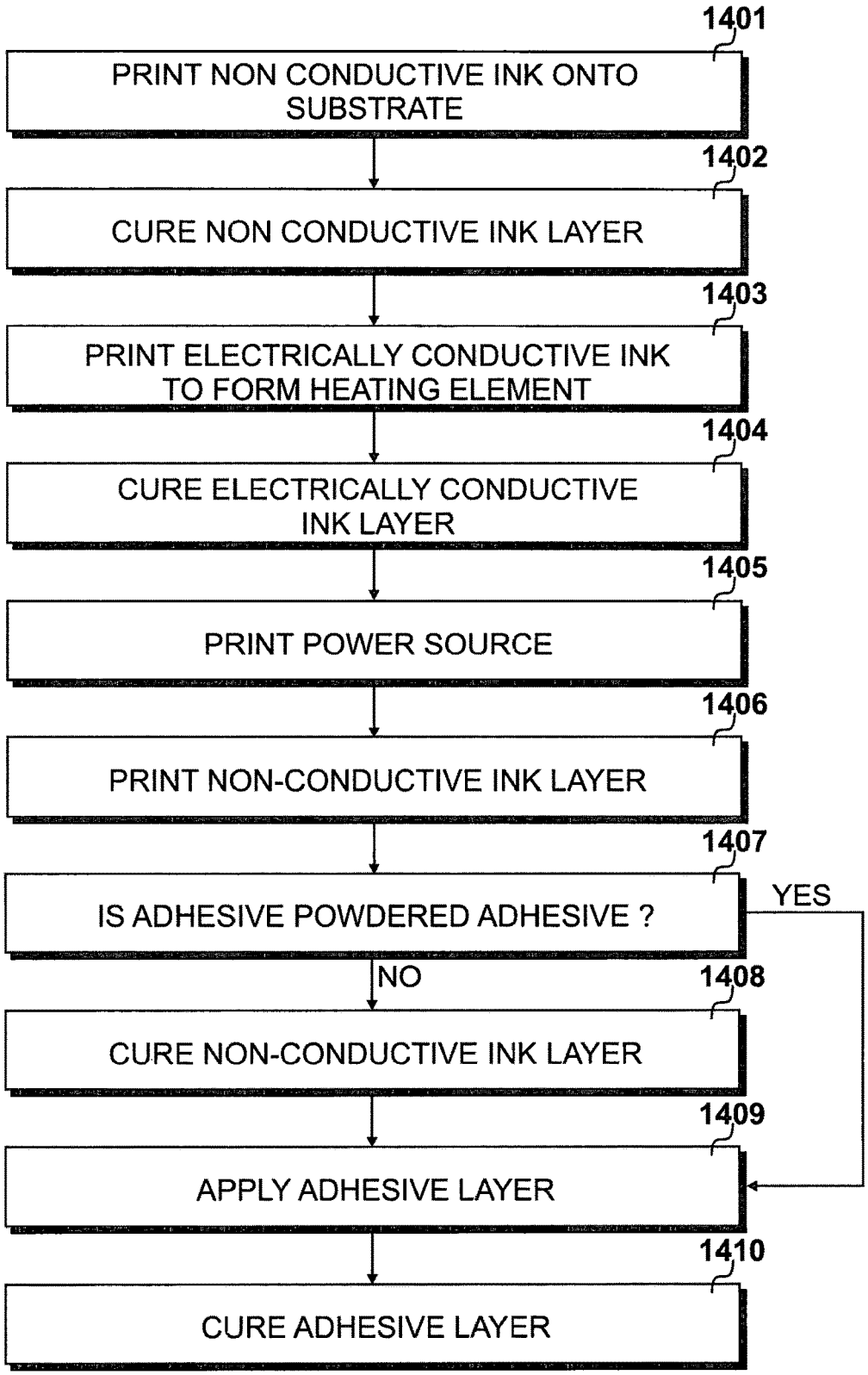
FIG. 14 shows a flow chart illustrating a method of producing a conductive transfer.
Figure 15:
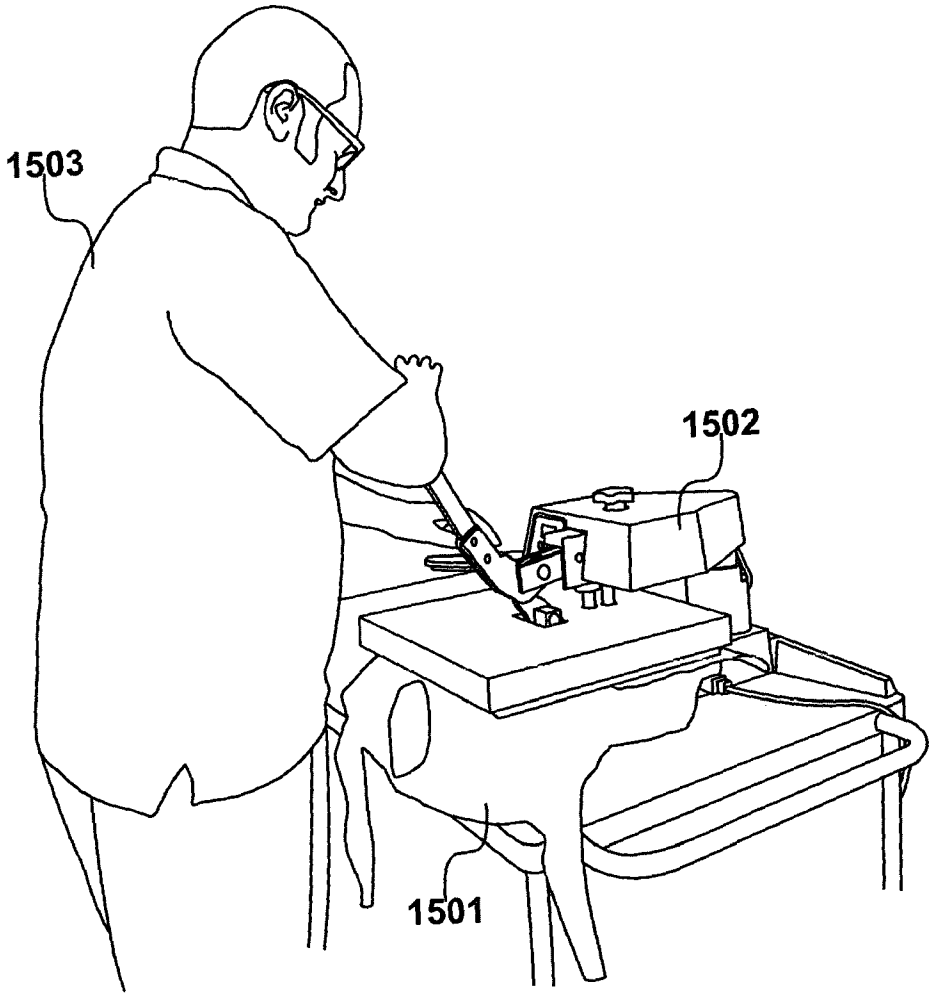
FIG. 15 shows the application of a conductive transfer to a surface of an article.

A method of producing a conductive transfer for application to a surface is illustrated in the flow chart of FIG. 14. At step 1401 a non-conductive ink is printed onto a substrate to produce a first non-conductive ink layer, such as non-conductive ink layer 203. This may be achieved by the method described in respect of FIGS. 11 and 12.

Figure 13:
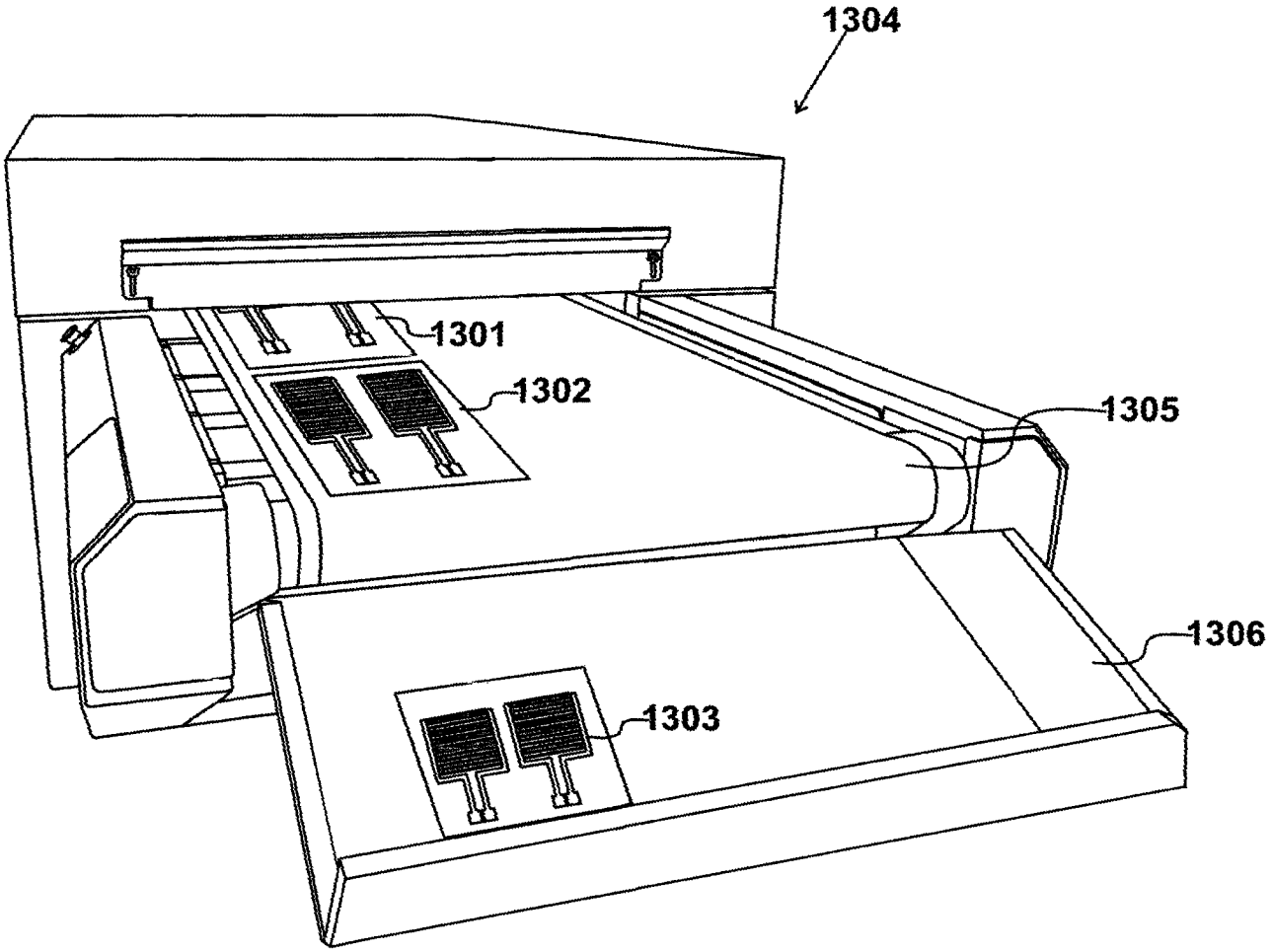
FIG. 13 shows a curing stage in the method of producing a conductive transfer.

At step 1402 printed non-conductive ink layer 203 is processed through curing machine 1404 and suitably cured and dried in the manner of FIG. 13. In the embodiment, the printing process may include a single pass of printed ink to form the non-conductive ink layer. However, in alternative embodiments, more than one pass may be performed such that the non-conductive ink layer comprises several separately formed non-conductive ink layers. Each layer may require its own individual curing step to ensure that the non-conductive ink layer has been printed adequately.

Figure 11:
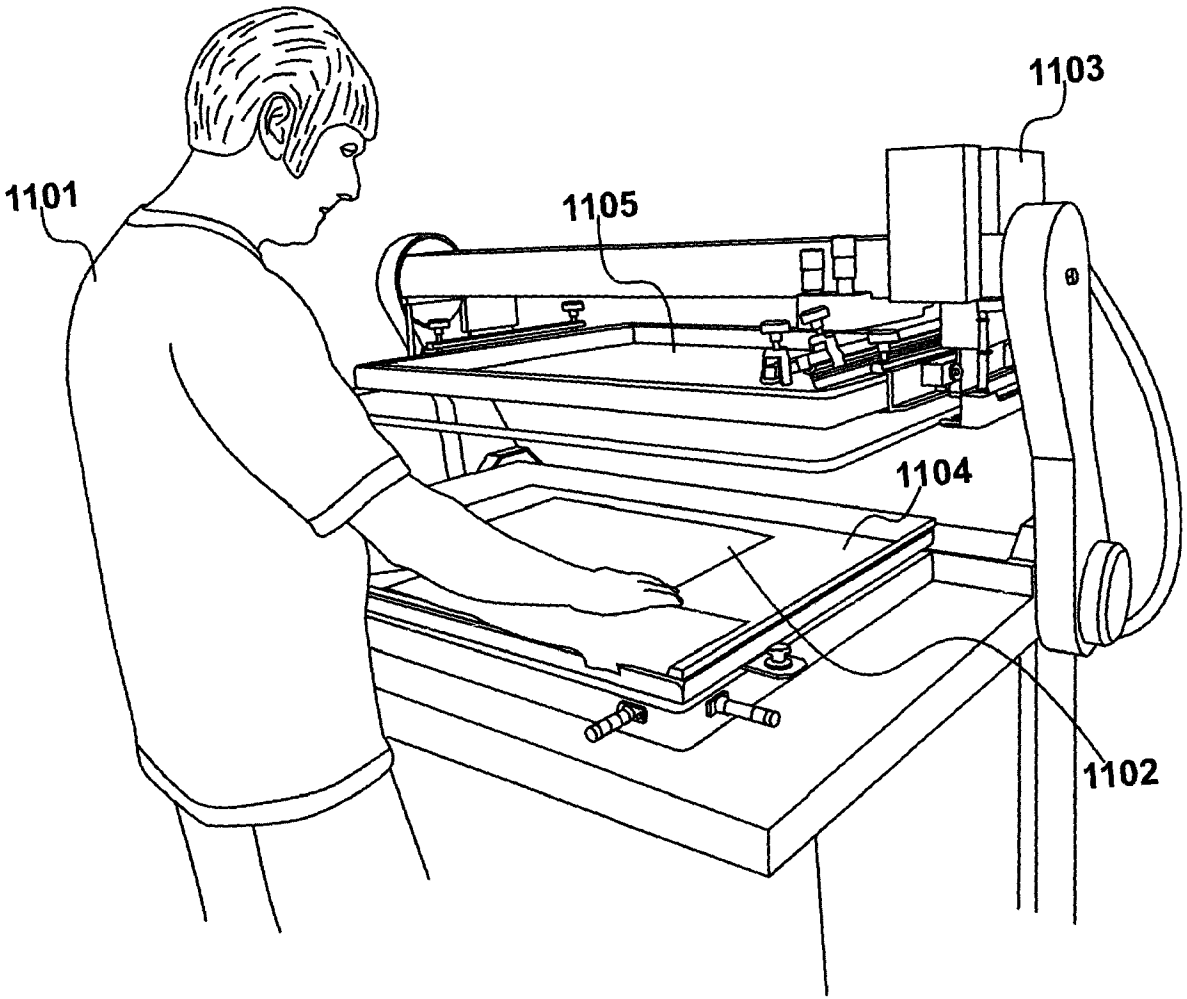
FIG. 11 shows a method of producing a conductive transfer utilising a screen-printing process.
Figure 12:
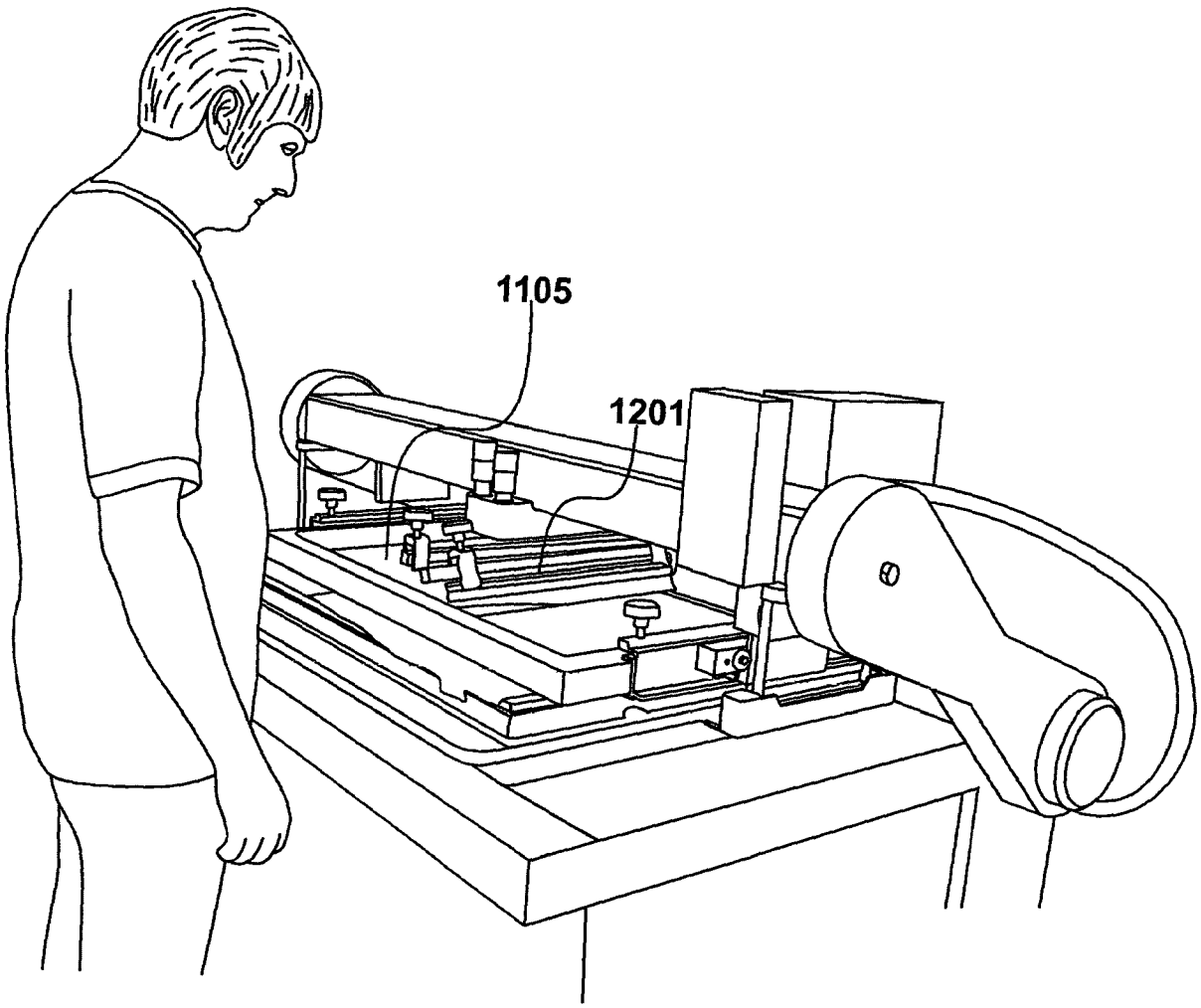
FIG. 12 shows a further step in the method of producing a conductive transfer.

Once non-conductive ink layer 203 has been suitably cured, the screen on the screen printer of FIGS. 11 and 12 is changed to that required for electrically conductive ink layer 206. Following this, at step 1403 an electrically conductive ink having a positive temperature coefficient is printed over the first non-conductive ink layer to produce a heating element 204. At step 1404, the electrically conductive ink is cured in a substantially similar manner to that as described in respect of FIG. 13. In the embodiment previously described, heating element 204 is formed by following steps 1403 and 1404 twice over, firstly for the electrically conductive ink layer 206 and secondly for the electrically conductive ink layer 205. It is appreciated that, in this embodiment where two electrically conductive layers form the heating element, each electrically conductive layer therefore is cured prior to application of the next electrically conductive layer.

In the embodiment comprising a printed power source, at step 1405 the process includes further printing and curing steps as required to provide the printed power source or battery by means of a printed ink. In the alternative embodiments where the power source is a conventional rechargeable battery, for example, step 1405 may be omitted.

Second non-conductive ink layer 202 is produced by printing the same non-conductive ink over heating element 204 at step 1406 in a similar manner. Again, non-conductive ink layer 202 may include several passes of a similar ink or a single pass as required.

If a printable adhesive is being used as opposed to a powdered adhesive then non-conductive ink layer 202 is cured in a substantially similar manner to those previously as indicated at steps 1407 and 1408. However, if the adhesive layer comprises a powdered adhesive then the adhesive layer is applied to the second non-cured non-conductive ink layer at step 1409 before curing of the adhesive layer is conducted at step 1410.

With this in mind, it is appreciated that while the conventional method is to cure each ink layer following each application of a layer these steps may be adapted or removed as necessary.

In the embodiment of FIG. 10, a further step of providing an insulating layer is included. As previously indicated, this may include printing, for example, a reflective layer and curing this layer in a similar manner to the printing and curing processes previously described. Alternatively, if the insulating layer is provided as a separate sheet, this step may include a process of attaching the insulating layer onto the second non-conductive ink layer.

In a further embodiment including an insulating layer, a further step of introducing an air gap between the insulating layer and the second non-conductive ink layer is further included.

FIG. 15

Following the production of the conductive transfer as described in FIGS. 11 to 14, the conductive transfer can be applied to a surface of an article such as the wearable item described in respect of FIG. 1. Conductive transfer 201 for example, is placed on the surface of a wearable item 1501.

Wearable item 1501 and the conductive transfer are then placed into a machine such as heat press 1502. Operative 1503 activates heat press 1502 to provide heat and pressure to the conductive transfer such that the conductive transfer adheres to the surface of wearable item 1501. In order to achieve this, it is appreciated that the adhesive layer is placed in contact with the surface of wearable item 1501 with the substrate forming the furthest most layer from surface 1501.

In the embodiment, the heat press applies a pressure substantially within a range of one hundred and forty-five to one hundred and eighty degrees Celsius (145-180° C.). In a particular embodiment the temperature applied is one hundred and sixty-five degrees (165° C.). It is appreciated that these temperatures are dependent on the type of heat press utilised in the manufacture of the conductive transfer.

It is also appreciated that in alternative embodiments, the conductive transfer is applied to a surface with the application of heat only or pressure only as well as being able to be applied by application of both heat and pressure. Any suitable machinery for applying this method may be utilised.

FIG. 16

As will be appreciated, the conductive transfer described herein is suitable for use as a heated transfer in a variety of applications, two examples of which will now be described with respect to FIGS. 16 and 17.

Figure 16:
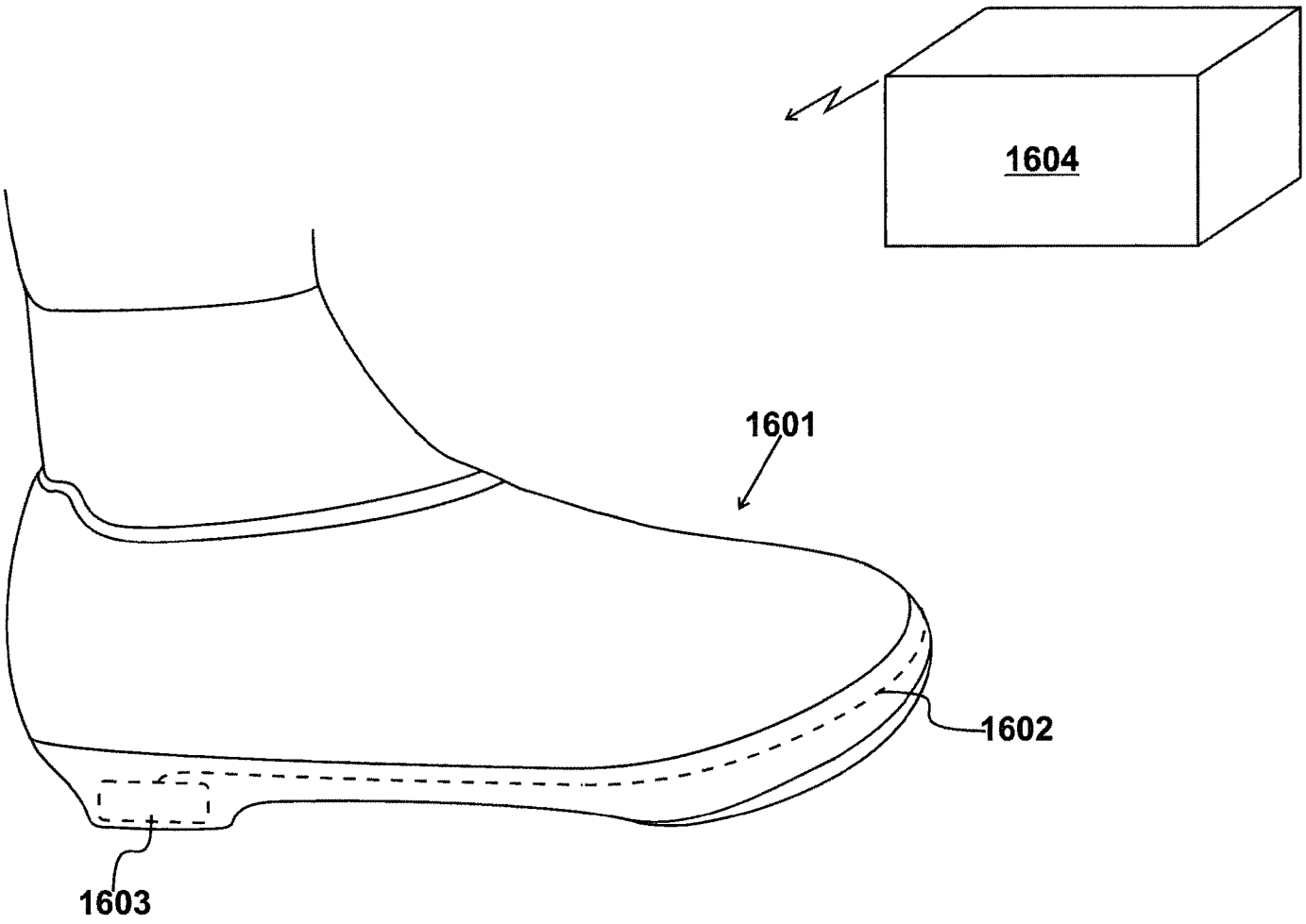
FIG. 16 shows the use of a heated conductive transfer in a footwear application.

In the embodiment of FIG. 16, an article comprising a conductive transfer is an item of footwear 1601 having conductive transfer 1602 fitted internally to the sole of the footwear, in a similar manner to a conventional insole. Footwear 1602 further comprises a power source 1603 which is fitted internally to the heel of the footwear and provides power to conductive transfer 1602. In the embodiment, power source 1603 comprises a rechargeable battery. This particular application may be suitable for industrial workers for example who are required to work in extremely cold temperatures to prevent heat loss through the feet or other medical issues caused by excessive exposure to such temperatures.

In the embodiment, while footwear 1601 is being worn by a user, conductive transfer 1602 can be activated so as to heat the wearer's foot appropriately. Rechargeable battery 1603 is preferably configured to provide sufficient battery power to cover a work-shift, for example, to ensure that conductive transfer is operative throughout the work-shift. Rechargeable battery 1603 is also configured to be wirelessly chargeable. Thus, in an example, at the end of the work-shift, footwear 1601 can be removed and placed in proximity of remote charging unit 1604. Remote charging unit 1604 is configured to wirelessly communicate with rechargeable battery 1603 to enable charging of rechargeable battery 1603.

It is appreciated that this process may also be possible in alternative embodiments whereby footwear 1601 does not need to be removed to enable charging to occur.

In a further embodiment, a similar system can be incorporated into other wearable items, for example, in an item of clothing such as a jacket or a suit. In this further embodiment, the remote charging unit may be incorporated into a storage system such as a wardrobe or as part of a clothes hanger and, once the item of clothing has been placed into storage, recharging is configured to occur.

FIG. 17

A heated conductive transfer in accordance with the invention may also be utilised in an application with a heated seat, such as those typically found in road vehicles. Car seat 1701 comprises a back support portion 1702 and a seat portion 1703. In the embodiment, a plurality of conductive transfers 1704, 1705, 1706 and 1707 have been included in the seat covering. This is preferable to conventional heated seats which require complex wiring which are also more cumbersome to install. It is appreciated that conductive transfers according to the present invention are able to be manufactured at various sizes in order to appropriately accommodate applications of this type, with different sized transfers being utilised for the back support portion and seat portion respectively.

Figure 17:
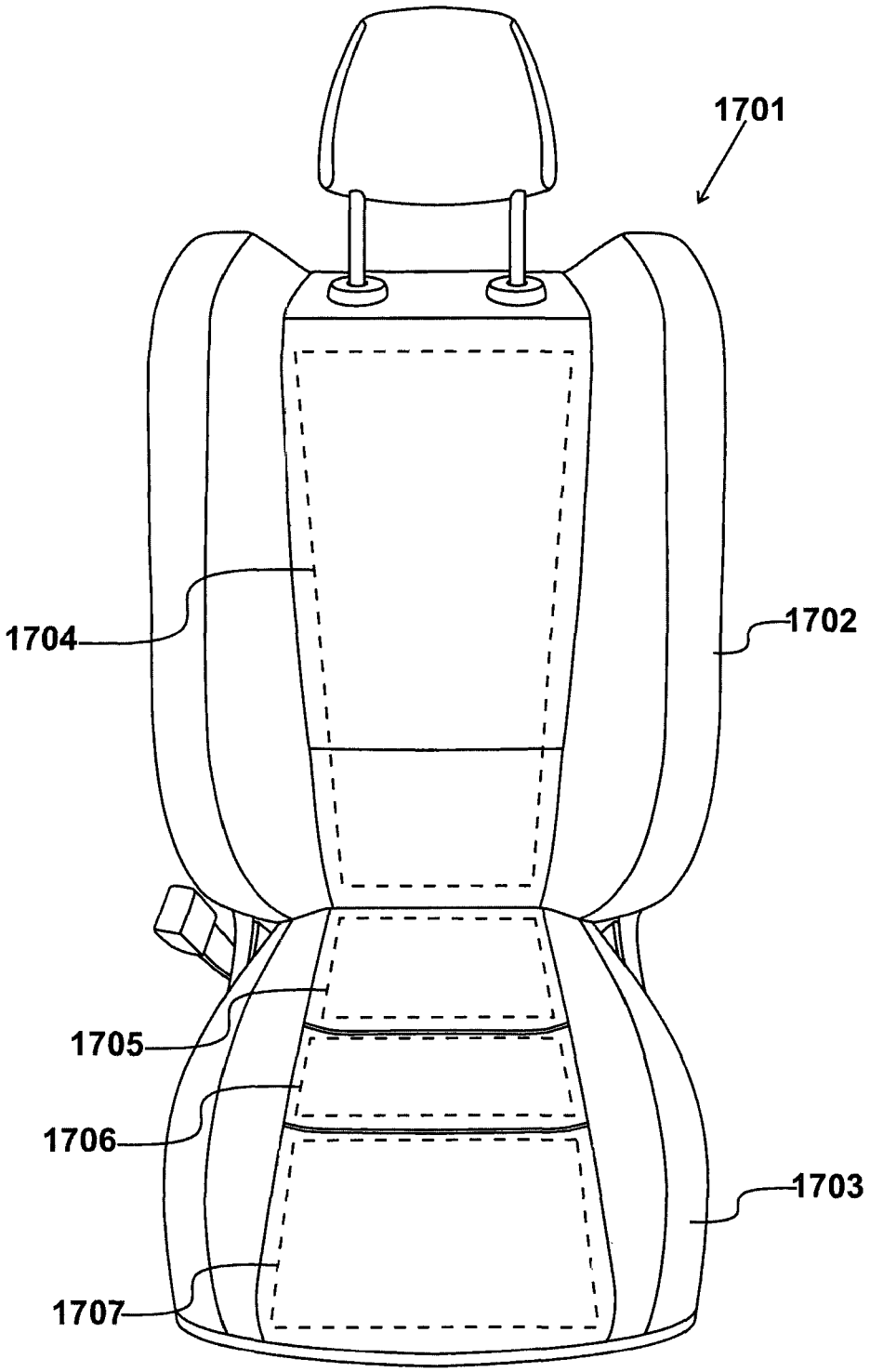
FIG. 17 shows the use of a heated conductive transfer in a road vehicle seat.

The examples provided in FIGS. 1, 16 and 17 are not considered exhaustive examples of articles in conductive transfers according to the present invention can be included. It is appreciated that a conductive transfer in accordance with the present invention may also be utilised in other automotive applications which require heating to be applied, for example, to heated steering wheels or to mechanical components within the engine bay to ensure a certain temperature is maintained. It is further appreciated that the conductive transfer may form part of any suitable article, such as a heated blanket, a heat sensor, a medical bandage or other medical dressing, heat pads for both medical or leisure applications, heated flooring or an electronic display.

In a particular example, the conductive transfer described herein is utilised in a heated blanket in a medical application. In particular, heated blankets in the medical industry can be utilised to prevent hypothermia in patients both during and after surgery and/or operations.

In particular, the conductive transfer described herein provides a low thickness (comparatively thin) heating element which can be applied to any surface without compromising the flexibility or stretchability of the heating element. The conductive transfer is also washable due to the encapsulating non-conductive ink layers so as to maintain the flexibility and stretchability of the heating element while retaining the functionality of the heating element and conductive transfer as a whole. This provides specific advantages for the wearables industry, as well as automotive and aerospace sectors.

FIG. 18

Figure 18:
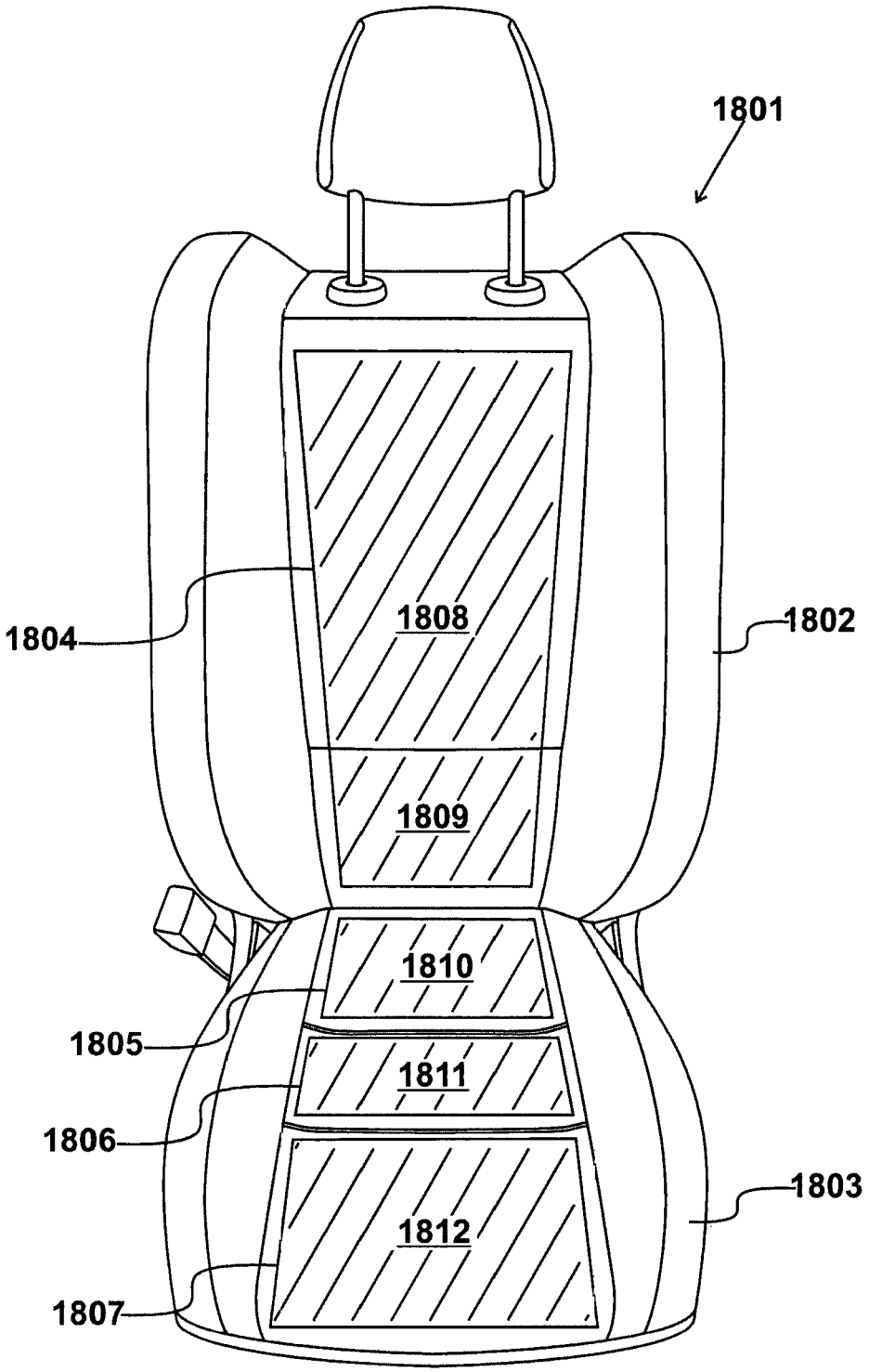
FIG. 18 shows the use of an alternative heated conductive transfer when affixed to the exposed outer surface of a road vehicle seat.

A further embodiment wherein any of the heated conductive transfers described herein can be utilised in an application with a heated seat is shown in FIG. 18. Car seat 1801 is substantially similar to car seat 1701 and comprises a back support portion 1802 and a seat portion 1803.

In the embodiment, a plurality of conductive transfers 1804, 1805, 1806 and 1807 have applied to the outer surface (often referred to in industry as the A side) of the seat covering of seat 1801. This therefore differs from the embodiment of FIG. 17 in the nature by which the conductive transfers are applied to the car seat, which in this embodiment, are exposed on the top exposed surface of the seat covering, rather than integrated onto an underside surface within the car seat.

As with the embodiment of FIG. 17, it is appreciated that conductive transfers according to the present invention are able to be manufactured at various sizes in order to appropriately accommodate applications of this type, with different sized transfers being utilised for the back support portion and seat portion respectively.

By providing conductive transfers 1804, 1805, 1806 and 1807 to the outer surface of car seat 1801, heat from the heated transfers, when activated, allow for increased efficiency of the transfer of heat to a driver or passenger sitting on car seat 1801. In this way, heated transfers 1804, 1805, 1806 and 1807 are in direct contact with the driver or passenger. In this regard, in an embodiment, heated conductive transfers 1804, 1805, 1806 and 1807 are provided with a protective layer to provide additional durability to the conductive transfer when exposed in this manner. In an embodiment, the protective layer comprises a suitable durable coating printed as the top layer of such a conductive transfer. In a specific embodiment, the durable coating is substantially transparent.

While heated conductive transfers 1804, 1805, 1806 and 1807 can be substantially similar to any of the previously described conductive transfers herein, in this illustrated embodiment, one or more of heated conductive transfers 1804, 1805, 1806 and 1807 further comprise a thermochromic layer. Thus, in the embodiment, as heated conductive transfers 1804, 1805, 1806 and 1807 emit heat due to their increase in temperature, the thermochromic layer undergoes a colour change in response to the heat to present an alternative appearance on the surface of car seat 1801.

In particular, for example, the thermochromic layer may be arranged to present an indicator that a particular temperature has been reached by either providing a change in colour or revealing a digital image printed as part of any of the heated conductive transfers.

Thus, in the embodiment, as the temperature of heated conductive transfers 1804, 1805, 1806 and 1807 increases, images 1808, 1809, 1810, 1811 and 1812 reveal an alternative appearance to the surface of car seat 1801 compared to its appearance when the heated conductive transfers 1804, 1805, 1806 and 1807 are at a lower temperature or inactive.

It is appreciated that, in the embodiment where a protective layer is provided in combination with a thermochromic ink layer, if the protective layer is positioned above the thermochromic layer, the protective layer is substantially transparent so as to ensure the thermochromic layer is visible. However, it is also anticipated that in further embodiments where the protective layer is substantially opaque, the protective layer is positioned underneath the thermochromic layer to provide additional durability to the remaining layers of the conductive transfer.

FIG. 19

Figure 19:
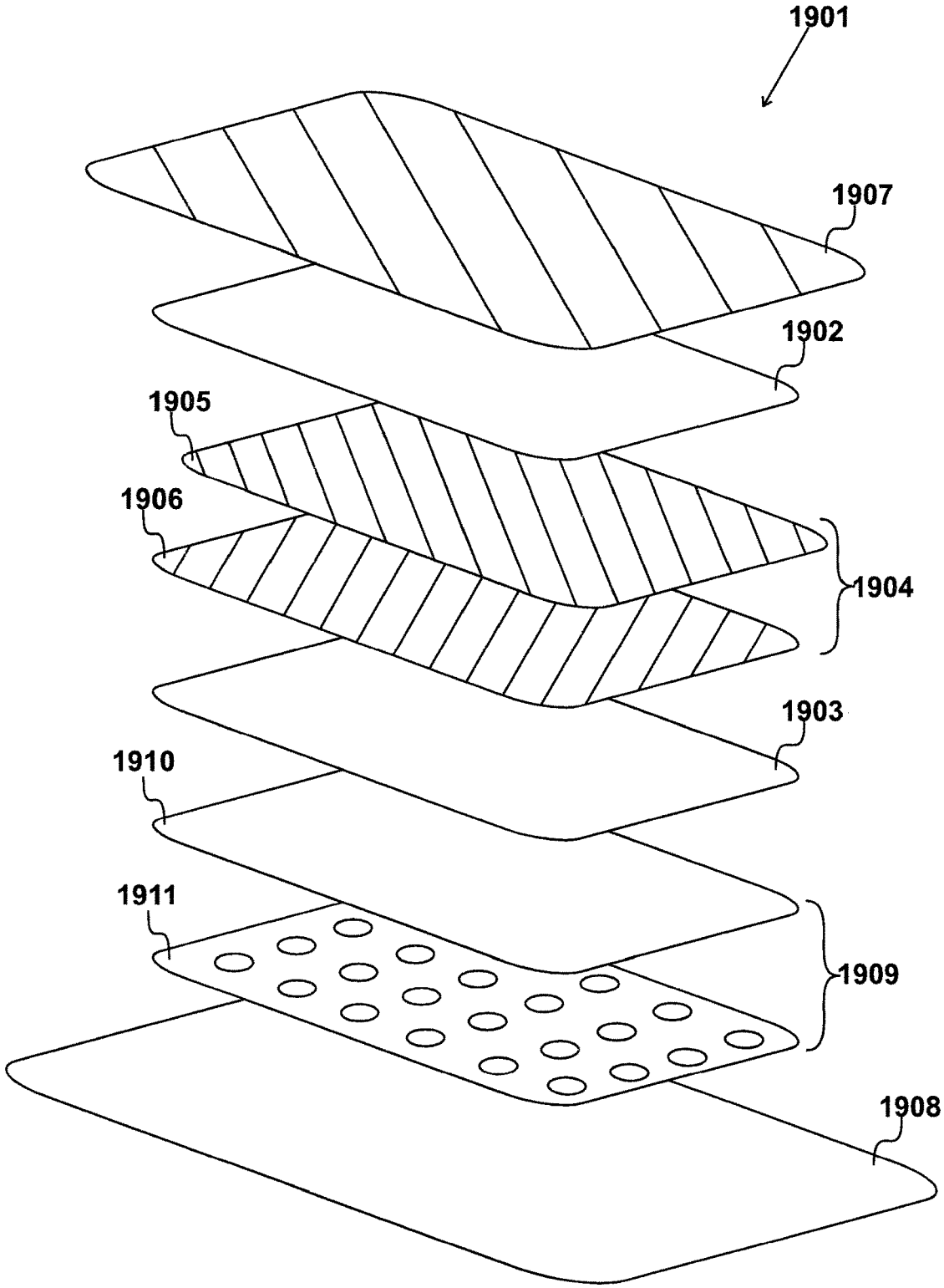
FIG. 19 shows an exploded schematic view of an alternative conductive transfer comprises a thermochromic layer.

An example heated conductive transfer comprising a thermochromic layer suitable for the application as described in respect of FIG. 18 is illustrated in an exploded schematic view in FIG. 19.

Conductive transfer 1901 comprises seven layers and a substrate, as will now be described. Conductive transfer 1901 comprises a first non-conductive ink layer 1902 and a second non-conductive ink layer 1903. The two non-conductive ink layers 1902 and 1903 are substantially similar in regards to their composition with each comprising a suitable printing ink which provides an encapsulant for a heating element, and is substantially similar to any of the previously described non-conductive ink layers.

A heating element 1904 is positioned between non-conductive ink layer 1902 and non-conductive ink layer 1903. In the embodiment, heating element 1904 comprises first and second electrically conductive ink layers 1905 and 1906. In the embodiment, electrically conductive ink layer 1905 comprises an electrically conductive ink having a positive temperature coefficient such that the electrically conductive ink exhibits an increase in resistance in response to an increase in temperature. The positive temperature coefficient ink is substantially similar to previously described positive temperature coefficient inks described herein, and further, heating element 1904 may comprise a larger number of layers or a single layer of material.

Electrically conductive ink layer 1906 comprises a metallic material which is provided in the form of an ink and is substantially similar to previously described electrically conductive ink layers in earlier embodiments. Conductive transfer 1901 further comprises an adhesive layer 1907 which is suitable for adhering conductive transfer 1901 to a suitable surface, such as the exposed outer surface of car seat 1801 or other alterative exposed surfaces of other suitable articles. In the embodiment, the adhesive layer comprises any suitable adhesive, such as those previously described herein, In manufacture, each of the layers are again printed onto a substrate 1908 which is configured to be removable from the remaining layers by means of an application of heat, pressure or a combination of heat and pressure. Thus, when applied, adhesive layer 1907 is brought into contact with the surface to which conductive transfer is to be applied, such as the exposed surface in the form of the car seat covering of FIG. 18, and heat and/or pressure is applied to substrate 1908 such that adhesive layer 1907 adheres conductive transfer 1901 to the surface.

Heated conductive transfer 1901 differs from previously described heated transfers herein by further inclusion of the thermochromic layer 1909. In the embodiment, thermochromic layer 1909 comprises a first layer 1910 which is configured to undergo a colour change in response to a change in temperature. Thus, in the embodiment, first layer 1910 comprises a thermochromic ink. In the embodiment, the thermochromic ink is configured to change from an opaque dark colour, such as black, to a clear transparent appearance.

Thermochromic layer 1909 further comprises a second layer 1911 which comprises a printed image. In the embodiment, the printed image is a digital image which is formed by a conventional digital screen-printing process. Thus, when combined with first layer 1910, in use, as heated transfer 1901 increases in temperature, layer 1910 undergoes a colour change from a dark opaque colour to a clear transparent appearance, thereby revealing the printed digital image of layer 1911. In this way, the digital image may be utilised to provide an alternative pattern, display information or provide alternative branding for a manufacturer as required. In an alternative embodiment, layers 1910 and 1911 may be positioned in the opposite order to that as shown.

The thermochromic layer 1909 therefore provides aesthetic possibilities but also can be utilised to provide a visual of the temperature of the heating element as the heating element increases in temperature during use.

While the example embodiment of FIG. 18 utilises the arrangement of FIG. 19, it is appreciated that a substantially similar conductive transfer to that of FIG. 19 may be utilised in alternative applications. For example, a substantially similar conductive transfer may again be utilised on a textile or wearable item to present a thermochromic layer.

In a further embodiment, conductive transfer 1901 (or alternatively any of the other conductive transfers described herein) is provided with a further anti-microbial layer. In an embodiment, the anti-microbial layer comprises an anti-microbial coating.

In a still further embodiment, any one of the conductive transfers described herein (for example, conductive transfers 201, 1001, 1901) comprises a thermocouple to enable monitoring of the temperature output from the conductive transfer. In an embodiment, the thermocouple comprises a substantially similar conductive ink to those forming the electrically conductive ink layers. For example, the thermocouple comprises a copper-based ink which may be combined with a constantan alloy in the manner of conventional thermocouples. Alternative materials for forming the thermocouples may be utilised such as those known in the art.

In an embodiment, a matrix of thermocouples may be created by printing a single track of a first conductive ink, for example, carbon black. A plurality of electrically conductive tracks of a further material, for example, a silver ink, is then printed in electrical connection with the single track of the first conductive ink to create a plurality of thermocouples. The plurality of thermocouples can then be connected to multiplexor such that a voltage can be measured from each of the thermocouples individually, thereby providing an individual reading of temperature for each thermocouple. In this way, the arrangement of thermocouples can be spread across a matrix across the cross section of the conductive transfer so that a temperature fluctuations and variations across the transfer can be determined. This therefore enables a two-dimensional map of thermal output across the transfer to be determined as an alternative for using a thermal vision camera.

In addition to the creation of a two-dimension map of thermal output, a similar arrangement may be extended to create a three-dimensional map of thermal output across the thickness of the transfer. For example, a thermocouple layer may be printed and positioned in electrical connection with the heating element, while a further thermocouple layer may be printed and positioned at alternative points in the transfer, such as close to the non-conductive layers. In this way, a map of heat transfer through the conductive transfer can be produced indicating the heat flow through the conductive transfer. This can then be reproduced to form a visual output via a processor or similar.

FIG. 20

Figure 20:
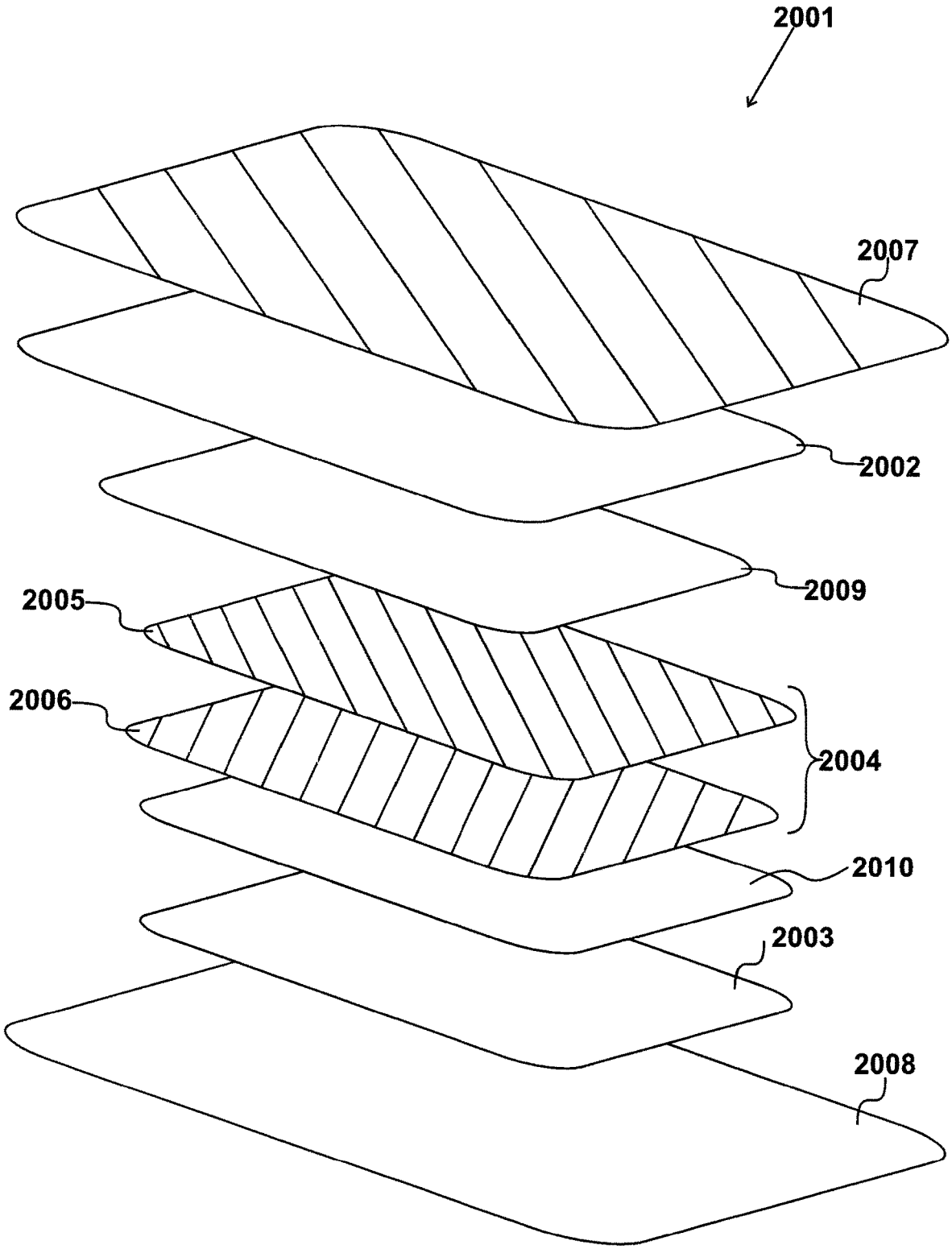
FIG. 20 shows a further alternative conductive transfer comprising a barrier layer.

A further alternative embodiment of a heated conductive transfer is illustrated in an exploded schematic view in FIG. 20. It is appreciated that the heated conductive transfer 2001 comprises substantially similar layers as conductive transfers described previously, however, in this illustrated embodiment, conductive transfer 2001 comprises a barrier layer.

Conductive transfer 2001 comprises a first non-conductive ink layer 2002 and a second non-conductive ink layer 2003. Conductive transfer 2001 further comprises a heating element 2004 which similarly comprises first and second electrically conductive ink layers 2005 and 2006. Again, in the embodiment, electrically conductive ink layer 2005 comprises an electrically conductive ink having a positive temperature coefficient such that the electrically conductive ink exhibits an increase in resistance in response to an increase in temperature.

Conductive transfer 2001 also comprises an adhesive layer 2007 which is suitable for adhering conductive transfer 2001 to a suitable surface. Each of the layers are printed onto a suitable removable substrate 2008.

Conductive transfer 2001, however, also comprises a barrier layer 2009 and a barrier layer 2010. In the embodiment, barrier layer 2009 is positioned between non-conductive ink layer 2002 and heating element 2004 so as to provide a barrier between heating element 2004 and adhesive layer 2007. In addition, barrier layer 2010 is positioned between non-conductive ink layer 2003 and heating element 2004. In an embodiment, one or both barrier layers 2009 and 2010 comprise a dielectric ink. It is appreciated that, in alternative embodiments, alternative inks may be utilised which are capable of providing a barrier between adhesive layer 2007 and heating element 2004. It is further appreciated that, in alternative embodiments, an alternative number of barrier layers are included, either one or more than the two described herein.

It has been noted by the inventors that typically suitable adhesive layers comprise plasticiser components which, when applied to a conductive transfer of the type herein, during the heating process, migrates through the layers of printed ink and onto the positive temperature coefficient electrically conductive ink layer 2005 and electrically conductive ink layer 2006. The plasticiser component of the adhesive is an insulator and thus, once it has migrated towards the layers of the heating element, the resistance of the heating element, and specifically that of the electrically conductive ink layer 2006, increases which leads to a reduced output of heat from the heated conductive transfer. Consequently, barrier layer 2009 is configured to prevent migration and diffusion of the plastic component in the adhesive layer into the electrically conductive ink layers to ensure that the heated conductive transfer retains performance through repeated use.

It is appreciated that, of the embodiments described herein, appropriate variations also fall within the scope of invention. For example, alternative embodiments that combine the features of more than one of the embodiments may be present in an alternative embodiment. For example, a conductive transfer which comprises both the barrier layers of conductive transfer 2001 and the thermochromic layer of conductive transfer 1901 is a suitable alternative embodiment for a potential application.

In a further embodiment, a plurality of heating elements may be utilised within a transfer to form a plurality of heated zones within the conductive transfer. In this embodiment, a common printed electrode is printed as part of a layer which forms an electrical connection with each of the heated zones. In this way, each heated zone can emit heat from their respective heating elements independently, but are controlled from a central controller and power source. Voltage is therefore supplied individually to each of the heated zones as required so that a first heated zone may be activated while a second heated zone may be inactive. This can be achieved both across the heated conductive transfer in a two-dimensional fashion or through the heated conductive transfer in a three-dimensional fashion.

This example is beneficial in an embodiment whereby the conductive transfer is applied to a wearable item. Consequently, the system is suitable such that different areas across the wearable item may be heated at different times, and a wearer may also be able to activate different zones depending on requirements.

In an embodiment, the zoned heated conductive transfer is combined with a plurality of printed thermocouples of the type described herein. Each zone is therefore provided with a respective thermocouple to provide a heat output per zone. In one embodiment, the tracks of the thermocouples are utilised as both the thermocouple and the heated element thereby reducing costs of production. In this embodiment, thermocouple measurements are made per zone utilising the shared tracks while the heated element is temporarily inactive.

In a still further embodiment, a zoned heated conductive transfer is used to control activation of the thermochromic layer and production of the digital image within the thermochromic layer. Thus, the zoned heated conductive transfer provides a colour display which comprises either a passive matrix type display or an active matrix display. In an embodiment of this type including a thermocouple or plurality of thermocouples, a temperature output from each thermocouple may be processed and consequently switching of the thermochromic layer is made accordingly. Displays of this type can be constructed having a high contrast and are cost-effective.

The invention claimed is:

1. A conductive transfer for application to a surface, comprising:

a first non-conductive ink layer and a second non-conductive ink layer;

a heating element positioned between said first non-conductive ink layer and said second non-conductive ink layer;

an adhesive layer for adhering said conductive transfer to said surface; wherein:

said heating element comprises an electrically conductive ink having a positive temperature coefficient such that said electrically conductive ink exhibits an increase in resistance in response to an increase in temperature; and a barrier layer positioned between said first non-conductive ink layer and said heating element to provide a barrier between said heating element and said adhesive layer so as to prevent migration of plastic components in said adhesive layer to said electrically conductive ink.

2. A conductive transfer according to claim 1, wherein said heating element is encapsulated between said first non-conductive ink layer and said second non-conductive ink layer, and said first non-conductive ink layer comprises a non-printed area in which said heating element is exposed to provide an electrical connection point.

3. A conductive transfer according to claim 1, further comprising a substrate onto which said first non-conductive ink layer is printed.

4. A conductive transfer according to claim 3, wherein said substrate is removable from said first non-conductive ink layer following an application of heat.

5. A conductive transfer according to claim 3, wherein said substrate is removable from said first non-conductive ink layer following an application of pressure.

6. A conductive transfer according to claim 1, wherein said heating element comprises a first electrically conductive ink layer and a second electrically conductive ink layer, said second electrically conductive ink layer comprising said electrically conductive ink having said positive temperature coefficient.

7. A conductive transfer according to claim 6, wherein said first electrically conductive ink layer comprises a metallic material and said second electrically conductive ink layer comprises a carbon-based ink.

8. A conductive transfer according to claim 7, wherein said metallic material is copper.

9. A conductive transfer according to claim 6, wherein said second electrically conductive ink layer comprises a plurality of positive temperature coefficient ink elements.

10. A conductive transfer according to claim 1, further comprising a power source configured to enable power to be provided to said heating element.

11. A conductive transfer according to claim 10, wherein said power source is configured to operate at a plurality of power levels.

12. A conductive transfer according to claim 10, wherein said power source comprises a printed ink.

13. A conductive transfer according to claim 10, wherein said power source comprises a rechargeable battery.

14. A conductive transfer according to claim 13, wherein said rechargeable battery is configured to be charged wirelessly.

15. A conductive transfer according to claim 1, further comprising an insulating layer.

16. A conductive transfer according to claim 15, wherein said insulating layer comprises an impermeable material.

17. A conductive transfer according to claim 15, wherein said insulating layer comprises a reflective material.

18. A conductive transfer according to claim 15, further comprising an air gap between said insulating layer and said second non-conductive ink layer.

19. A conductive transfer according to claim 1, further comprising a thermochromic layer.

20. A conductive transfer according to claim 19, wherein said thermochromic layer comprises a first layer comprising an ink configured to undergo a colour change in response to a change in temperature, and a second layer comprising a printed image.

21. A conductive transfer according to claim 1, wherein said barrier layer comprises a dielectric ink.

22. A conductive transfer according to claim 1, further comprising an anti-microbial layer.

23. A conductive transfer according to claim 1, further comprising a protective layer.

24. A conductive transfer according to claim 1, further comprising a plurality of heating elements defining a plurality of heated zones within said conductive transfer.

25. A conductive transfer according to claim 24, wherein each said heated zone comprises a thermocouple to provide a reading of temperature output from each said heated zone.

26. A conductive transfer according to claim 1, further comprising at least one thermocouple configured to provide a reading of temperature output from said conductive transfer.

27. An article comprising the conductive transfer of claim 1, said article comprising any one of the following:

a wearable item; a heated seat; a heated blanket; a heat sensor; a medical bandage; a heat pad; heated flooring; or an electronic display.

28. An article according to claim 27, wherein said article comprises an exposed surface, said conductive transfer being affixed to said exposed surface.

29. An apparatus comprising the conductive transfer of claim 14, further comprising a remote charging unit configured to wirelessly communicate with said rechargeable battery so as to enable charging of said rechargeable battery.

30. A method of producing a conductive transfer for application to a surface, comprising the steps of:

printing a non-conductive ink onto a substrate to produce a first non-conductive ink layer;

printing an electrically conductive ink onto said first non-conductive ink layer to produce a heating element, said electrically conductive ink having a positive temperature coefficient such that said electrically conductive ink exhibits an increase in resistance in response to an increase in temperature;

printing said non-conductive ink over said heating element to produce a second non-conductive ink layer; and printing an adhesive material over said second non-conductive ink layer to produce an adhesive layer, said method further comprising the steps of:

printing a barrier layer to provide a barrier between said heating element and said adhesive layer; and positioning said barrier layer between said first non-conductive ink layer and said heating element to prevent migration of plastic components in said adhesive layer to said electrically conductive ink.

31. A method of producing a conductive transfer according to claim 30, further comprising the step of:

printing a power source comprising a printed ink.

32. A method of producing a conductive transfer according to claim 30, further comprising the step of:

attaching or printing an insulating layer onto said second non-conductive ink layer.

33. A method of producing a conductive transfer according to claim 32, further comprising the step of:

introducing an air gap between said insulating layer and said second non-conductive ink layer.

* * * * *